US009419322B2

(12) United States Patent
Tantawi

(10) Patent No.: US 9,419,322 B2
(45) Date of Patent: Aug. 16, 2016

(54) COMPACT WAVEGUIDE CIRCULAR POLARIZER

(71) Applicant: The Board of Trustees of the Leland Stanford Junior University, Palo Alto, CA (US)

(72) Inventor: Sami G. Tantawi, Stanford, CA (US)

(73) Assignee: The Borad of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 14/641,938

(22) Filed: Mar. 9, 2015

(65) Prior Publication Data

US 2015/0194720 A1 Jul. 9, 2015

Related U.S. Application Data

(63) Continuation-in-part of application No. 14/530,223, filed on Oct. 31, 2014, now abandoned, which is a continuation of application No. 14/208,922, filed on Mar. 13, 2014, now abandoned.

(60) Provisional application No. 61/787,730, filed on Mar. 15, 2013, provisional application No. 61/952,383, filed on Mar. 13, 2014.

(51) Int. Cl.

| | |
|---|---|
| ***H01P 5/16*** | (2006.01) |
| ***H01P 5/08*** | (2006.01) |
| ***H01P 3/127*** | (2006.01) |
| ***H01P 1/16*** | (2006.01) |
| ***H01P 5/20*** | (2006.01) |

(52) U.S. Cl.
CPC *H01P 5/082* (2013.01); *H01P 1/16* (2013.01); *H01P 3/127* (2013.01); *H01P 5/20* (2013.01)

(58) Field of Classification Search
CPC ..... H01P 1/16; H01P 1/162; H01P 3/127; H01P 5/082; H01P 5/16; H01P 5/162; H01P 5/20
USPC ..... 333/117, 21 R, 33, 125
See application file for complete search history.

(56) References Cited

U.S. PATENT DOCUMENTS 2,892,982 A * 6/1959 Allen ..... H01P 5/16 333/117
2,941,166 A * 6/1960 Meyer ..... H01P 5/082 333/125
4,126,835 A 11/1978 Gould (Continued)

*Primary Examiner* — Robert Pascal
*Assistant Examiner* — Kimberly Glenn
(74) *Attorney, Agent, or Firm* — Lumen Patent Firm

(57) ABSTRACT

A multi-port waveguide is provided having a rectangular waveguide that includes a Y-shape structure with first top arm having a first rectangular waveguide port, a second top arm with second rectangular waveguide port, and a base arm with a third rectangular waveguide port for supporting a $TE_{10}$ mode and a $TE_{20}$ mode, where the end of the third rectangular waveguide port includes rounded edges that are parallel to a z-axis of the waveguide, a circular waveguide having a circular waveguide port for supporting a left hand and a right hand circular polarization $TE_{11}$ mode and is coupled to a base arm broad wall, and a matching feature disposed on the base arm broad wall opposite of the circular waveguide for terminating the third rectangular waveguide port, where the first rectangular waveguide port, the second rectangular waveguide port and the circular waveguide port are capable of supporting 4-modes of operation.

5 Claims, 34 Drawing Sheets

(56) References Cited

U.S. PATENT DOCUMENTS 6,452,559 B1 9/2002 Yuanzhu
6,859,184 B2 2/2005 Ohtani et al.
8,077,103 B1 12/2011 Acosta et al.
2007/0013457 A1* 1/2007 Tavassoli Hozouri .. H01P 1/067 333/21 R
2007/0075801 A1* 4/2007 Okano ..... H01P 1/066 333/21 R

* cited by examiner

COMPACT WAVEGUIDE CIRCULAR POLARIZER

CROSS-REFERENCE TO RELATED APPLICATIONS

This application is a continuation-in-part of U.S. patent application Ser. No. 14/530,223 filed Oct. 31, 2014, which is incorporated herein by reference. U.S. patent application Ser. No. 14/530,223 is a continuation of U.S. patent application Ser. No. 14/208,922 filed Mar. 13, 2014, which is incorporated herein by reference. U.S. patent application Ser. No. 14/208,922 filed Mar. 13, 2014 claims priority from U.S. Provisional Patent Application 61/787,730 filed Mar. 15, 2013, which is incorporated herein by reference. U.S. patent application Ser. No. 14/208,922 filed Mar. 13, 2014 claims priority from U.S. Provisional Patent Application 61/952,383 filed Mar. 13, 2014, which is incorporated herein by reference.

STATEMENT OF GOVERNMENT SPONSORED SUPPORT

This invention was made with Government support under contract no. DE-AC02-76SF00515 awarded by the Department of Energy. The Government has certain rights in the invention.

FIELD OF THE INVENTION

The present invention relates generally to both lower-power and high-power RF waveguide devices. More specifically, it relates to a 3-dB hybrid device for use in high power RF systems that are also compact and broadband.

BACKGROUND OF THE INVENTION 3-dB hybrids are used in high power RF circuits to realize a verity of components such as distributed loads, pulse compression systems, circulators, phase shifters, variable couplers, etc. Hence the synthesis of planner hybrids, with some times overmoded dimensions for use with ultra-high power applications have been the subject of interest for a long time. 3-dB hybrids are four port devices with a "matched" scattering matrix (diagonal elements are all zeros) representation that couples one port to the other two ports equally and the remaining port is isolated. This is true for all 4 ports. There are many realizations for this device.

What is needed is a 3-dB hybrid device for use in high power RF systems that are also compact and broadband.

SUMMARY OF THE INVENTION

To address the needs in the art, a multi-port waveguide is provided that includes a rectangular waveguide, where the rectangular waveguide includes a Y-shape structure having a first top arm, a second top arm, and a base arm, where the first top arm includes a first rectangular waveguide port, where the second top arm includes a second rectangular waveguide port, where an end of the base arm includes a third rectangular waveguide port that is capable of supporting a $TE_{10}$ mode and a $TE_{20}$ mode, where the end of the third rectangular waveguide port includes rounded edges that are parallel to a z-axis of the rectangular waveguide, a circular waveguide that includes a circular waveguide port that is capable of supporting a left hand circular polarization $TE_{11}$ mode and a right hand circular polarization $TE_{11}$ mode, where the circular waveguide is coupled to a broad wall of the base arm of the rectangular waveguide, and a matching feature, where the matching features is disposed on the broad wall of the base arm that is opposite of the circular waveguide, where the matching feature is capable of terminating the third rectangular waveguide port, where the first rectangular waveguide port, the second rectangular waveguide port and the circular waveguide port are capable of supporting 4-modes of operation.

According to one aspect of the invention, the matching feature includes a stub feature that projects outward from the broad wall of the base arm.

In another aspect of the invention, the matching feature includes a capacitive dome that projects inward from the broad wall of the base arm.

In a further aspect of the invention, the matching feature includes a pin feature that projects outward from the broad wall of the base arm.

In yet another aspect of the invention, the circular waveguide is disposed at a pre-defined distance from a junction of the first top arm and the second top arm along the base arm, where the pre-defined distance is according to matching and phase properties of the left hand circular polarization $TE_{11}$ mode and the right hand circular polarization $TE_{11}$ mode, where a phase difference between the $TE_{11}$ mode along the first top arm and the $TE_{11}$ mode the second top arm is 90-degrees.

BRIEF DESCRIPTION OF THE DRAWINGS

(FIG. 14A) 28 GHz, (FIG. 14B) 31 GHz and (FIG. 14C) 34 GHz, according to one embodiment of the invention.

(FIG. 21B) phase difference of two orthogonal $TE_{11}$ modes, according to one embodiment of the invention.

FIG. 29 shows the transient field distribution for the broadband dual circular polarizer, according to one embodiment of the invention.

DETAILED DESCRIPTION

The current invention comprises a hybrid 4-port device physically configured as a 3-port device, where two ports are lumped together in one single physical port that have two modes. According to one embodiment, the physical port has a circular cross section and the two modes representing the two ports are the two polarization of the $TE_{11}$ mode. Furthermore, the individual polarizations representing the two ports are the left and right hand circular polarizations of the $TE_{11}$ mode. This type of device that has three physical ports with 4 modes of operations, two of which are the left handed and right handed circularly polarized mode and has the same representation as a 3-port hybrid is called herein a "polarizer."

There are many embodiments for these polarizers, but the subject of the current invention is one embodiment that allows the use of this device in high power RF systems. The embodiment is also compact and broadband.

Figure 1:
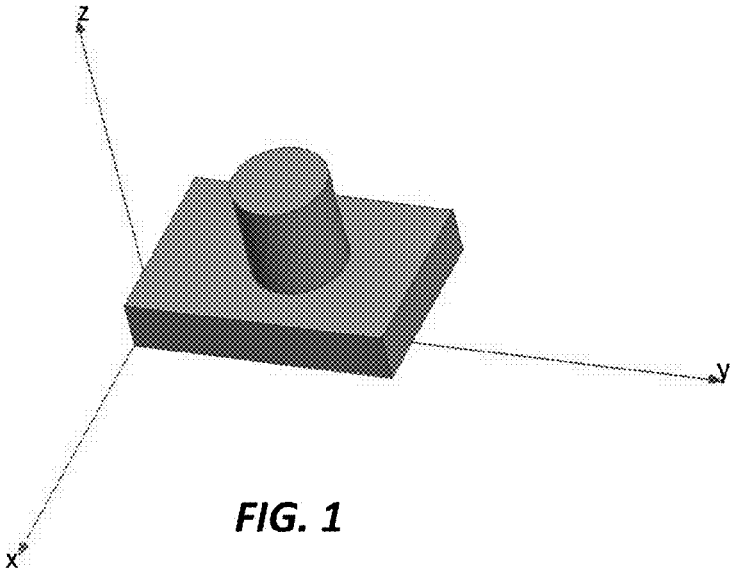
FIG. 1 shows a circular waveguide coupled to a rectangular waveguide from the broad side, according to one embodiment of the invention.

The current invention starts by noticing that a circular waveguide connected at the broad wall of a rectangular waveguide, as shown in FIG. 1, could have a one to one correspondence between the modes of the rectangular guide and the circular guide. This means that one of the linear polarizations of the circular waveguide will couple to one and only one mode in the rectangular waveguide and the other polarization will couple to a completely different mode in the rectangular waveguide. To be precise, referring to FIG. 1, the $TE_{11}$ mode polarized along the y axis will couple to the $TE_{10}$ mode in the rectangular waveguide while the $TE_{11}$ mode polarized along the x-axis will couple to the $TE_{20}$ mode in the rectangular waveguide. Hence, one has to choose the dimensions of the rectangular waveguide, precisely the broad dimension, to allow for the propagation of the $TE_{10}$ and $TH_{20}$ modes, and only those two modes. Likewise the diameter of the circular waveguide should allow only the two polarizations of the $TE_{11}$ mode to propagate.

Figure 2:
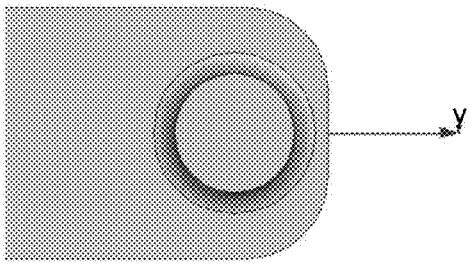
FIG. 2 shows termination of the guide for matching both the $TE_{10}$ mode and the $TE_{20}$ mode to the circular waveguide $TE_{11}$ modes, according to one embodiment of the invention.

The next step of the design is accomplished by noticing that if one put an artificial plane parallel to the Zz-y plane (see FIG. 1) along the axis of symmetry of the structure the structure split into to symmetrical parts. If a boundary condition of a perfect electric wall or a perfect magnetic wall is placed along this plane, in other words if one consider either odd or even symmetries of the field in the structure, one would get a perfectly symmetrical three port network, with the circular port in the center of symmetry. Invoking known theories for three port networks, then, there exists a position for a termination (a short circuit), that allow a perfect match between one of the ports and the central port. This means that there exist a position for a short circuit that allow a perfect match for either the $TE_{10}$ mode to couple to the $TE_{11}$ mode along the y-direction and another position that will match the $TE_{20}$ mode to the $TE_{11}$ mode along the x-direction. To match both at the same time we recognize that the sort circuit can be achieved at different positions for both modes by shaping the end of the rectangular waveguide, as shown in FIG. 2.

Figure 3:
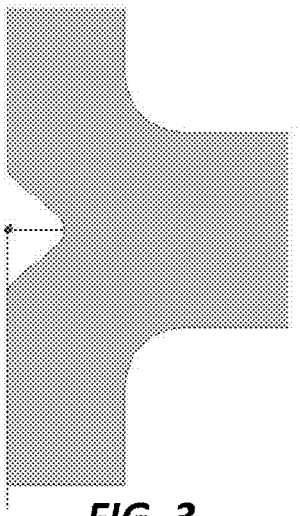
FIG. 3 shows a hybrid based on two fundamental mode waveguide and one overmoded waveguide port, according to one embodiment of the invention.

The next step of the design is to excite the $TE_{10}$ mode and the $TE_{20}$ modes in the rectangular guide through a "four port" 3-dB hybrid, with two ports being two separate ports and one physical port that contain the $TE_{10}$ and the $TE_{20}$ mode, as shown in FIG. 3. This hybrid, typically needing a matching element in the center of the broad waveguide, can eliminate that by perturbing the match of the section containing the circular waveguide. This is accomplished by the choosing the position of the circular port with respect to the rectangular hybrid and the shape of the short circuit termination at the end (see FIG. 3).

Figure 4:
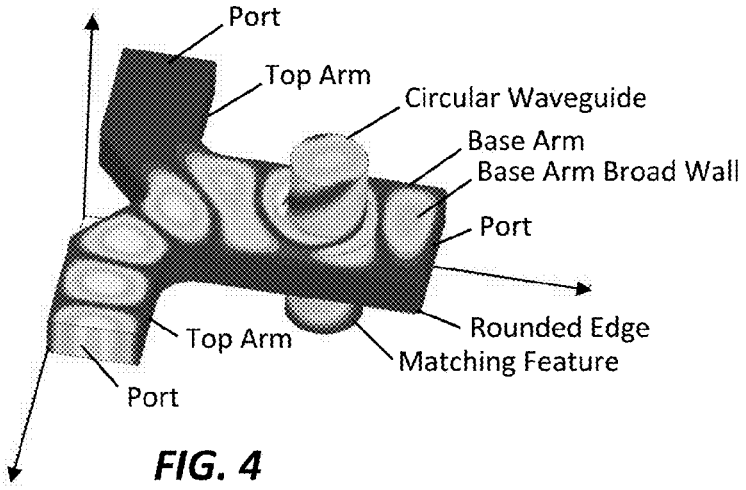
FIG. 4 shows a polarizer with a stub matching, according to one embodiment of the invention.
Figure 5:
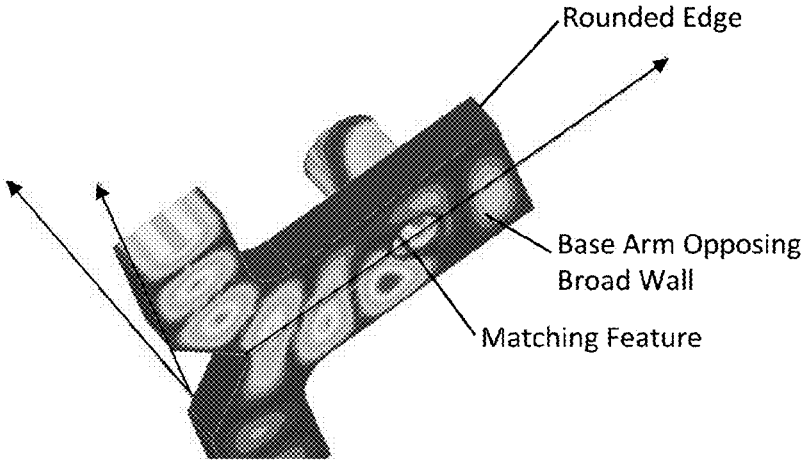
FIG. 5 shows a polarizer with a capacitive dome matching, according to one embodiment of the invention.
Figure 6:
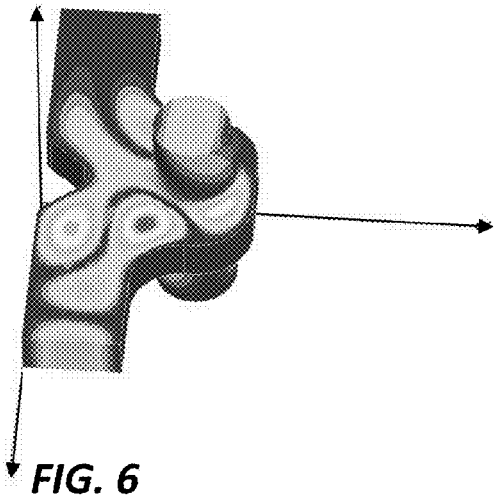
FIG. 6 shows a compact version of the polarizer with a stub matching, according to one embodiment of the invention.

To create a circular polarization the phase difference between the $TE_{11}$ mode along the x and the $TE_{11}$ mode along the y need to differ by 90 degrees. This is done also by choosing the phase difference between the $TE_{10}$ mode and the $TE_{20}$ mode in the rectangular waveguide. This is accomplished also be choosing the distance between the circular port and the rectangular hybrid along the y-axis. Since this distance control both the matching and the phase properties of the two polarizations one need another degree of freedom, this is done by adding either a dome or stub underneath the circular guide. FIGS. 4-6 show some exemplary embodiments of the current invention, where the field patterns are those obtained by finite element simulations.

The polarizer shown in FIGS. 4-6 allows for a verity of applications. First one should notice that a short circuit or a reflection at the circular port results in changing the propagation direction due the reflection of the waves from that port. However, the direction of rotation will not change. This shows that the helicity of the wave has been reversed and hence the reflected power will all go to the isolated rectangular port. With no reflection towards the source placed at the first rectangular port.

If the reflection happens through a lossy material such as stainless steel or something that has less conductivity, a matched load can be constructed by chaining a plurality of these polarizers one after the other, according to one embodiment. In another embodiment, if the reflection happens through a movable short then a phase shifter is constructed. If a reflection happens through a high quality factor cylindrical or spherical cavity a pulse compression system is realized. This would be the most compact pulse compressor constructed to date, according to a further embodiment. Finally if the reflection happens with a piece of ferrite mediatized along the circular waveguide axis one would achieve an isolator, where the power going in one direction between the two rectangular ports would suffer no losses in one direction and would be greatly attenuated in the other direction, according to another embodiment of the invention. To accommodate high power operation one can chain several of these isolators together and hence the losses could be distributed among them, according to further embodiments.

Finally with the embodiment addressing lossy materials, the embodiment could be enhanced by the use of the $EH_{11}$ mode in corrugated circular waveguide as part of the termination to increase the losses; the $EH_{11}$ mode is essentially a surface wave. Also regarding the embodiment incorporating a piece of ferrite mediatized along the circular waveguide axis, the embodiment could be enhanced by the use of the $HE_{11}$ mode in corrugated circular waveguide to allow for perfect circular polarizations locally at the ferrite or the garnet surface to minimize spurious loses for the forward direction and to enhance the isolation in the reverse direction.

According to a further embodiment of the invention, a compact and wide-band waveguide dual circular polarizer at Ka-band is presented herein. This compact structure is composed of a three-port polarizing diplexer and a circular polarizer realized by a pair of large grooves. The polarizing diplexer includes two rectangular waveguides with a perpendicular H-plane junction, one circular waveguide coupled in E-plane. A cylindrical step and two pins are used to match this structure. For a left hand circular polarization (LHCP) or right hand circular polarizer (RHCP) wave in the circular port, only one specific rectangular port outputs power and the other one is isolated. The accurate analysis and design of the circular polarizer are conducted by using full-wave electromagnetic simulation tools. The optimized dual circular polarizer has the advantage of compact size with a volume smaller than $1.5\lambda^3$, broad bandwidth, uncomplicated structure, and is especially suitable for use at high frequencies such as Ka-m, band and above. The prototype of the polarizer has been manufactured and tested, the experimental results are consistent with the theories.

According to one embodiment, the invention applies to large-format focal plane arrays, which could be used in the next generation of cosmic microwave background (CMB) polarization experiments to understand the very early Universe. The detected B-mode polarization is from Ka band to W band, which is received by the antenna array of circular feed horns. There are hundreds of units in the antenna array, thus each unit should be as compact as possible, wideband, and straightforward to mass-produce. The right hand and left hand circular polarized component (RHCP and LHCP) of the B-mode Q±iU include important information, Q and U need to be amplified synchronously rather than separately, thus, before the amplifiers, dual circular polarizer is used to separate the circular polarized Q±iU in two ports with linear polarizations (LP), one of which contains the information of Q+iU, and the other is for Q−iU.

The circular polarizer is usually designed to convert one linearly polarized mode into two orthogonal modes with a 90-degree phase shift by loading the discontinuities of septum, corrugations, and dielectrics. The waveguide septum polarizer has the advantage of compact size with three physical ports, but has a very limited bandwidth due to phase shift of two orthogonal modes; the dielectric-loaded polarizer has relative high loss. The polarizer for corrugations, dielectrics, and ridges are two physical ports, and need ortho-mode transducer (OMT) to separate the LHCP and RHCP. The Boifot OMT has broad bandwidth but with very complex matching structure. There are four physical rectangular ports for turnstile OMT, which need two waveguide rings to respectively combine the ports with same polarization. Thus, turnstile OMT is not compact and the two waveguide rings may decrease the final bandwidth. The compact three-port branching OMT composed by two H-plane rectangular waveguides coupled with a common circular waveguide uses two bottleneck-like irises to match the structure and realize the isolation, whose return loss <−10 dB had a bandwidth <12%, and isolation <−35 dB with a bandwidth >10%. Other kinds of circular polarizers such as microstrip polarizer also have the disadvantage of narrow bandwidth and low efficiency due to losses of conductor, dielectric and surface wave.

As mentioned above, since there are hundreds of units in the antenna array for detecting CMB, the dual circular polarizer have compact size and broad bandwidth. The exemplary embodiment focuses on the Ka-band with frequency from 26 GHz to 36 GHz. Firstly, a compact 3 physical-port polarizing diplexer is provided, which can separate the circular polarized wave Q±iU from a circular port into two separate rectangular ports with linear polarized Q and ±iU. Then, two symmetric grooves are used to form the circular polarizer.

Figure 7:
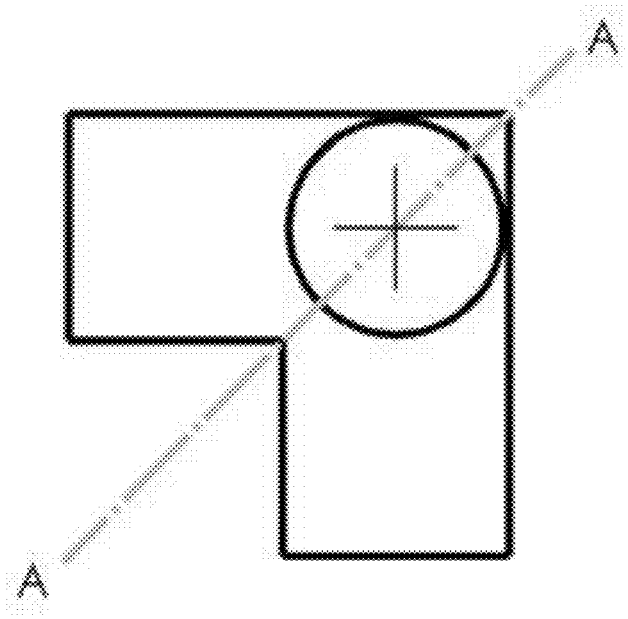
FIG. 7 shows a schematic drawing of the symmetric 3-port polarizing diplexer; Port 1, Port 2 and Port 3 are defined as shown, according to one embodiment of the invention.

Turning now to the compact polarizing diplexer, the compact three physical-port polarizing diplexer illustrated is shown in FIG. 7 includes two rectangular waveguides with a perpendicular H-plane junction and one circular waveguide coupled in E-plane. This device contains a symmetric diagonal plane, called AA, which decomposes the structure into two equal halves. Because of the symmetry of the structure about AA, the full structure can be optimized by solving just one of the halves. The plane AA is defined to be the XZ plane in 3-dimensional Cartesian coordinates.

When the rectangular port 1 or 3 feeds in a $TE_{10}$ mode, a specific $TE_{11}$ mode polarized along the incident rectangular waveguide is generated, which can be further decomposed along the X and Y axes. In other words, for a $TE_{10}$ mode inserted in port 1, two orthogonal $TE_{11}$ modes with phase difference 0° respectively along X and Y axes are excited, compared with two $TE_{11}$ modes with phase difference 180° for incident $TE_{10}$ mode from port 3.

Figure 8A:
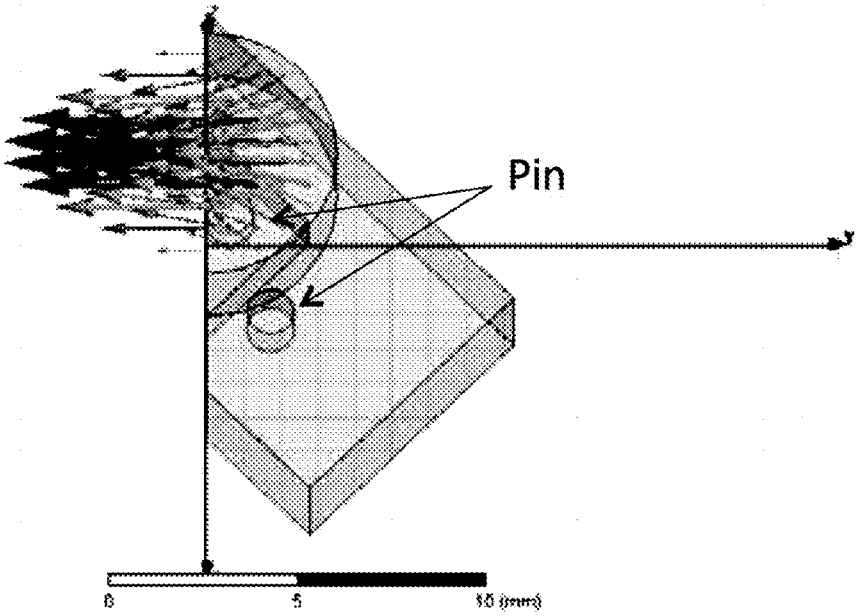
FIGS. 8A-8B show electric field vector distributions for the symmetric diagonal plane as (FIG. 8A) a perfect electric wall and (FIG. 8B) a perfect magnetic wall, where the frequency is 31 GHz, according to one embodiment of the invention.
Figure 8B:
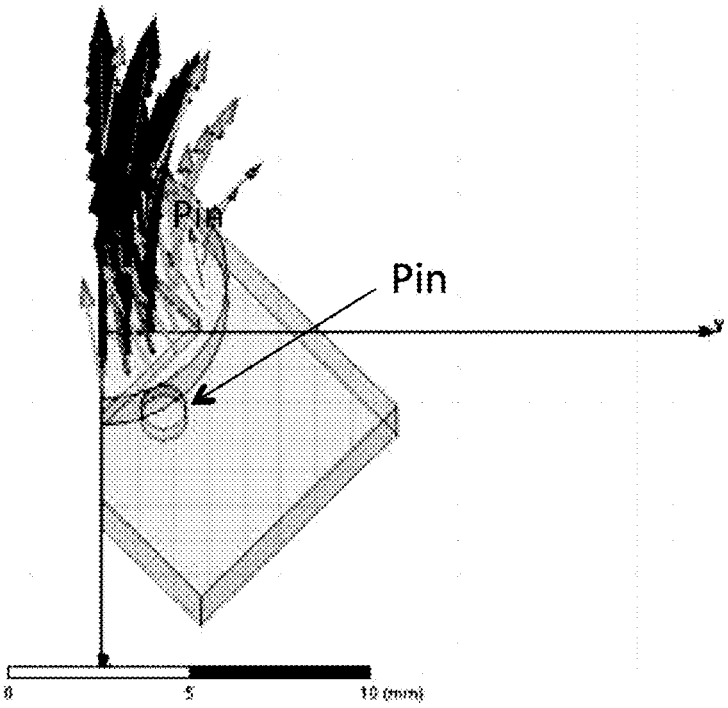

Optimization variables are used to define a central rectangular step as well as one pin on this step and located at the strong electric field region in the ½ structure. Full-wave electromagnetic simulation HFSS software is used to optimize the structure. In order to realize the whole structure matched, no matter for the symmetric plane AA (see FIG. 7) is electric or magnetic boundary, there should be a broadband result for the 1/2 structure. First of all, AA plane is assumed to be a perfect electric boundary, as shown in FIG. 8A, and the parameters of the step and one pin are optimized. Then, AA is assumed to be a perfect magnetic boundary, as shown in FIG. 8B, and another pin at the bottom of the waveguide is added in the strong magnetic region, which is far away from the strong electric field region. Consequently, the second pin should have a weak influence on the optimized result for AA as an electric boundary.

Figure 9:
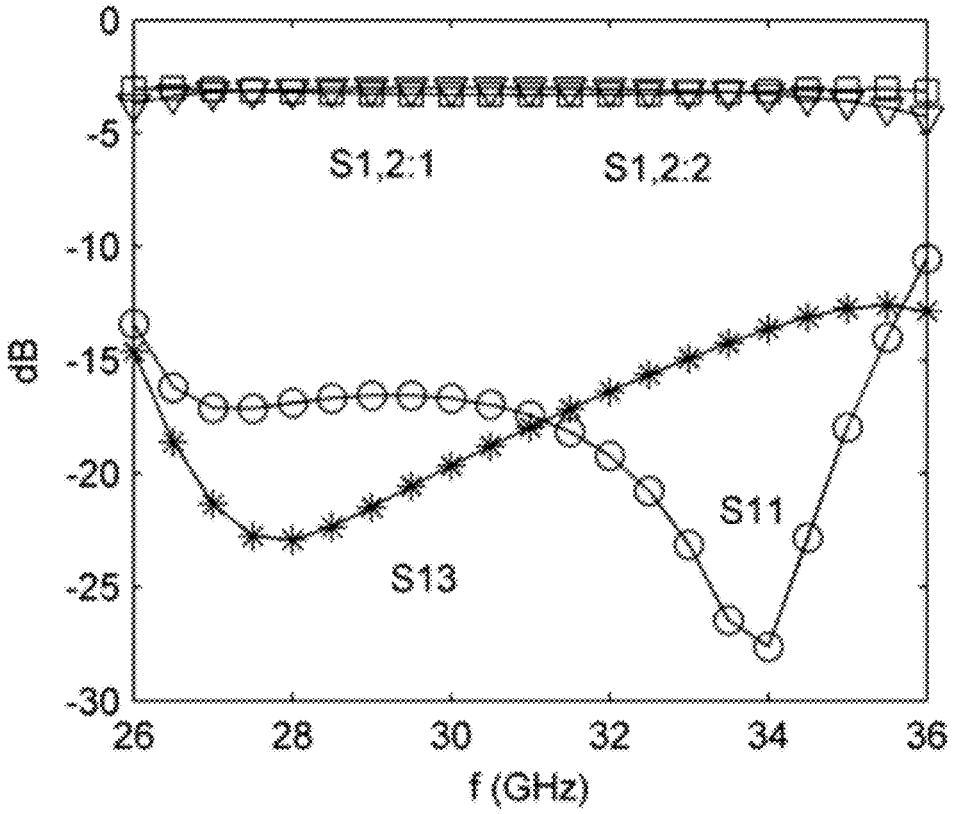
FIG. 9 shows optimized S-parameters for structure with four pins; 2:1 represents Port 2: mode 1, and 2:2 represents Port 2: mode 2, according to one embodiment of the invention.

It is found that the four pins structure is very difficult to optimize since there are too many parameters to consider, and the optimized $S_{11}$ and $S_{13}$ is about from −10 dB to −25 dB within the target bandwidth, as shown in FIG. 9. Thus, a circular step is used instead of the rectangular one and the four pins are replaced by two. Then, the key parameters for matching the structure are the radius $R_1$ and the height $Z_1$ of the step, the center position $X_1$ of the step and the circular waveguide, the radius $R_2$, height $Z_2$ and the location $X_2$ and $Y_2$ of the pins.

The optimization module of HFSS software has a strong ability in matching a structure at a single frequency, but is not ideal for optimizing over a large bandwidth. Thus, the influence of the step and pins on the S parameters within the bandwidth is investigated by sweeping the parameters of the structure, while the S parameters at the central frequency (31 GHz) and the edge frequencies (26 GHz and 36 GHz) are monitored. The sweep results for each variable are plotted in separate graphs in FIGS. 10A-10G.

Figure 10A:
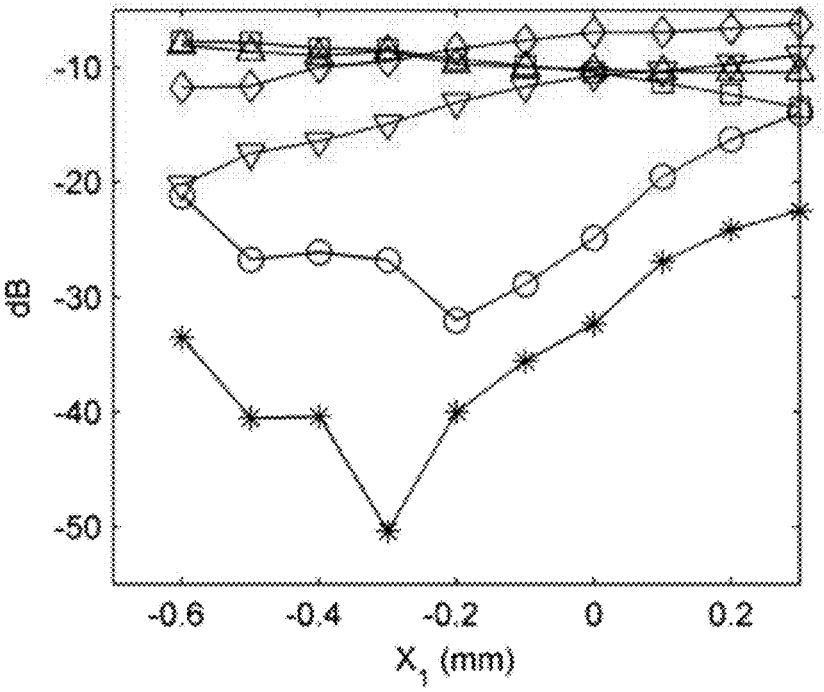
FIGS. 10A-10G show variation of the S parameters with the parameters of (FIG. 10A) X1, (FIG. 10B) Z1, (FIG. 10C) X2, (FIG. 10D) Y2, (FIG. 10E) Z2, (FIG. 10F) R1 and (FIG. 10G) R2, the data of symbol ○, Δ, □ represent for S11 at 31 GHz, 26 GHz, and 36 GHz, and *, ◇; and ∇ for S13 at 31 GHz, 26 GHz, and 36 GHz, according to one embodiment of the invention.
Figure 10B:
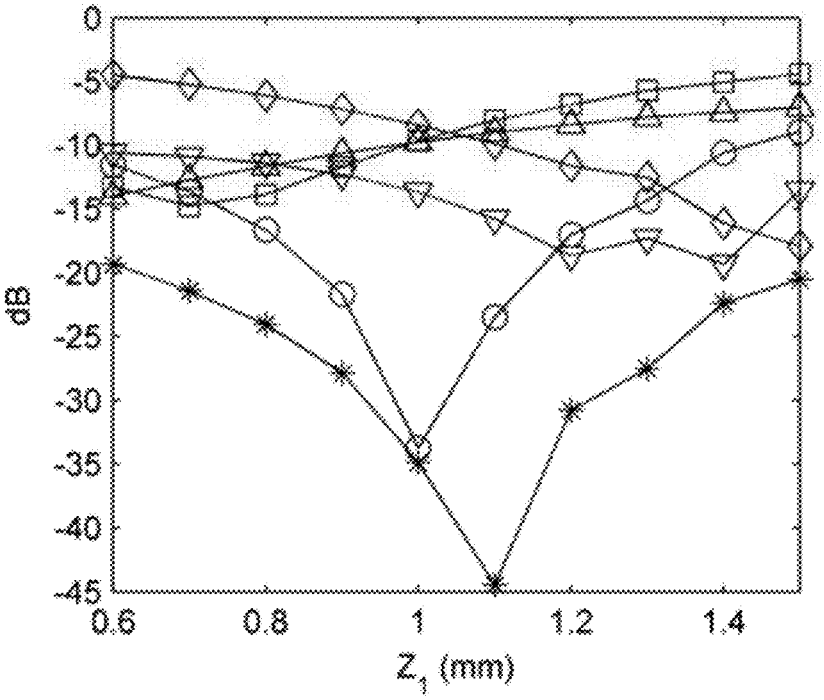
Figure 10C:
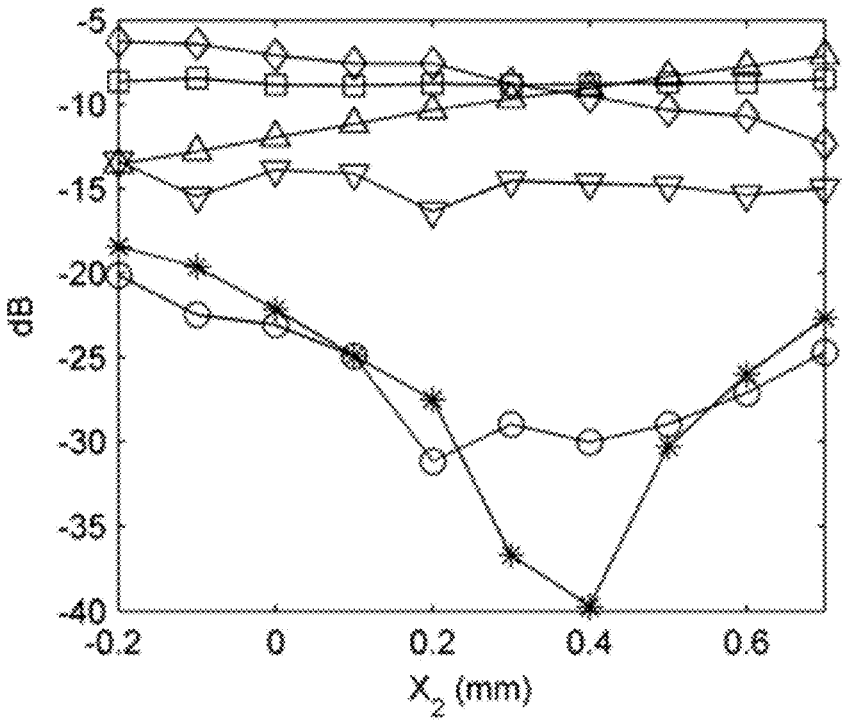
Figure 10D:
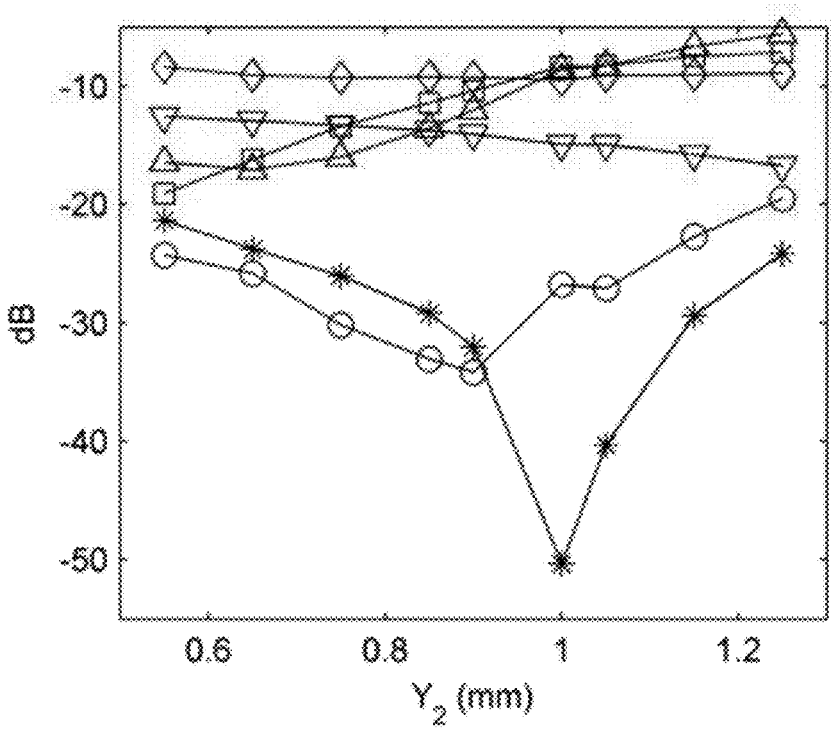
Figure 10E:
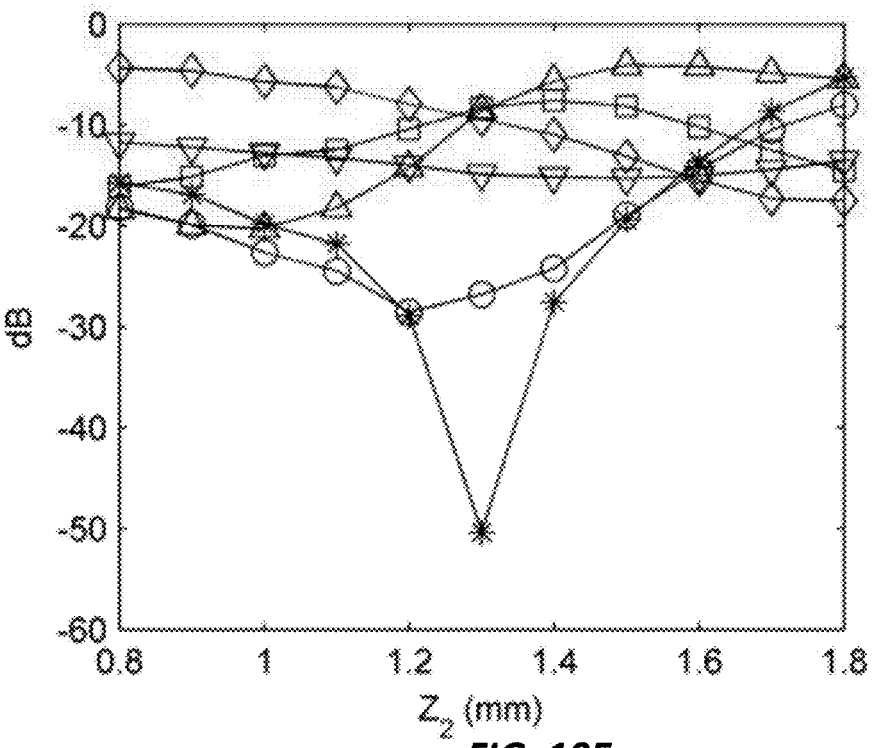
Figure 10F:
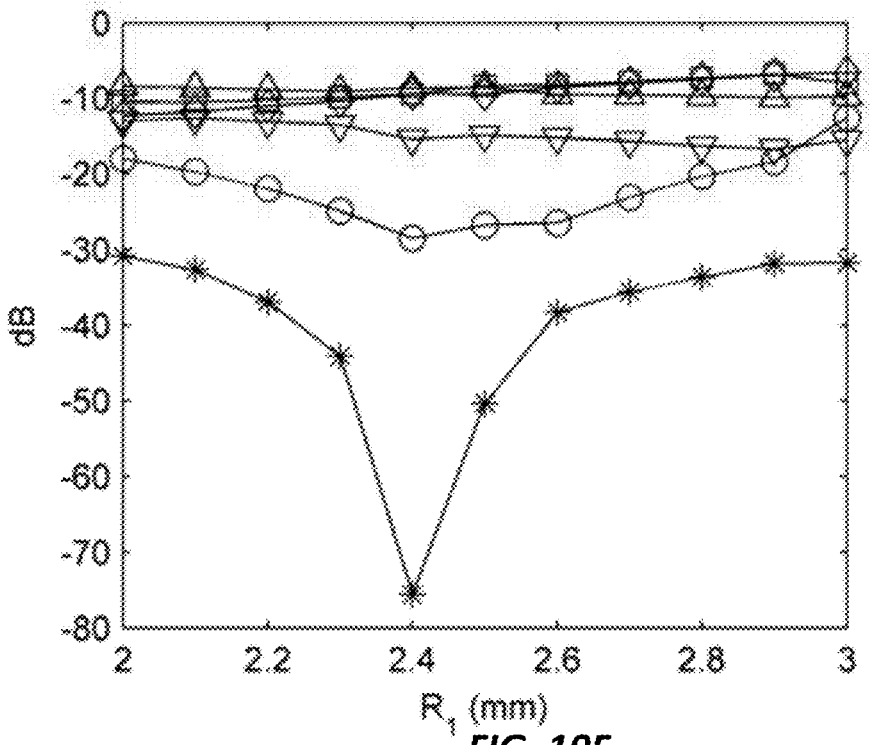
Figure 10G:
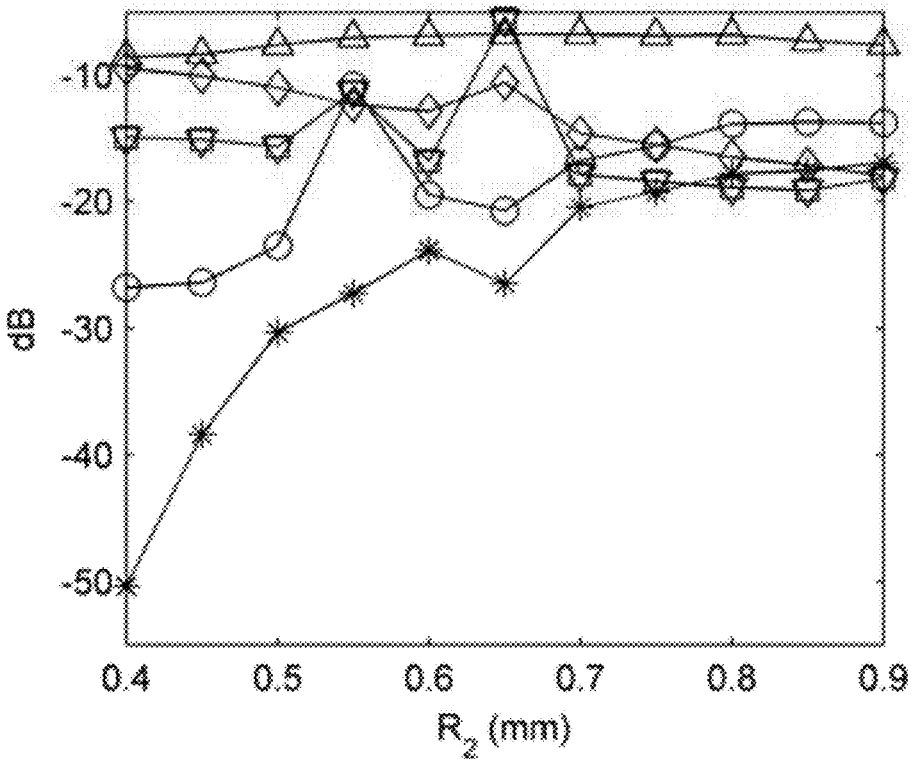

It is shown in FIG. 10A when the center position $X_1$ of the step and the circular waveguide deviates a little from the coordinate center and moves along the X-axis to the range $X_1$~0.2 to ~0.4 mm, the return loss and isolation are significantly decreased. Additionally, when the radius of the step is $R_1$~2.4-2.5 mm and the height is 0.9-1.2 mm, both $S_{11}$ and $S_{13}$ are small. The structure is matched well when the pins deviate a little from the center of the step with $X_2$~0.2-0.4 mm the central distance between the two pins reaches $2Y_2$~2*(0.9-1) mm, and the height is $Z_2$~1.2-1.4 mm. Finally, a smaller $R_2$ has a higher isolation. It should be emphasized that taking the coordinate satisfying the symmetric plane AA to be the Y Z plane was very important for calculating the optimization results.

Figure 11A:
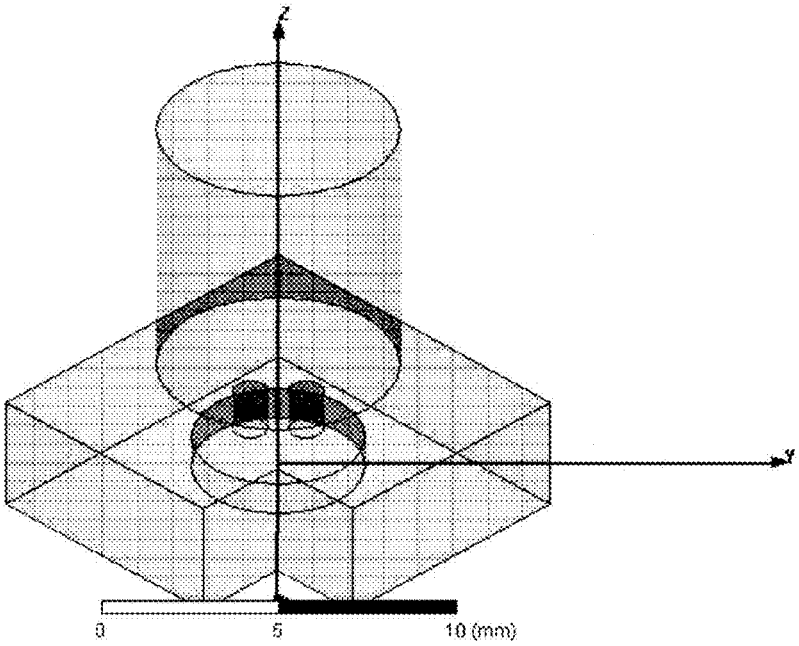
FIGS. 11A-11B show (FIG. 11A) the final structure of 3-port compact polarizing diplexer and (FIG. 11B) the optimized S parameter, according to one embodiment of the invention.
Figure 11B:
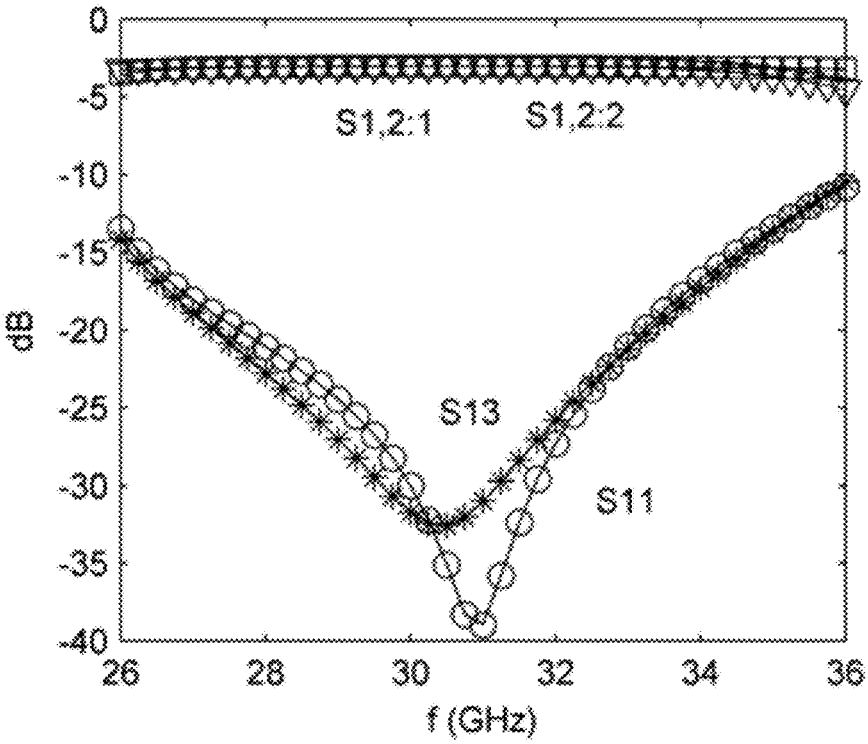

Besides, the optimized broadband structure should keep $S_{11}$ and $S_{13}$ at the boundary frequencies 26 GHz and 36 GHz as low as possible. After sweeping the above multi-parameters of the pins and the step, the researched range of the variables for a matched structure could become smaller. The structure and the optimized S-parameters for the compact broadband polarizing diplexer is shown in FIG. 11A and FIG. 11B. Compared with FIG. 9, the S parameters of the new structure in FIGS. 11A-11B have much lower return loss and higher isolation. The modes 1 and 2 in port 2 have 0° or 180° phase difference.

Turning now to the design of one embodiment of the dual circular polarizer, a pair of grooves along the symmetric plane AA are used to adjust the phase difference $\Delta\phi$ of the two orthogonal modes reaching 90° and keep the broadband result. A polarizer with single groove was researched. To keep the symmetric of the polarizer in this exemplary embodiment, a pair of large grooves are adopted, which can realized a broad bandwidth because it excites higher order modes, and weakens the frequency dependence of the phase variation $\beta L$, where L is the length of the groove and $\beta$ is the propagation constant. For instance with a depth 2.5 mm and width 1.5 mm, a length $L\sim\lambda$, is needed to realize $\Delta\phi\sim 90°$, smaller grooves, with depth 1 mm and width 1 mm, would need a length of $L\sim 3\lambda$, to reach $\Delta\phi\sim 90°$ at 31 GHz and the dependence of $\Delta\phi$ on frequency is very sensitive due to a larger phase variation $\Delta\beta L$ compared with a shorter L. By sweeping the height, width, and length of the grooves, the optimized parameters are illustrated in FIGS. 12A-12B.

Figure 12A:
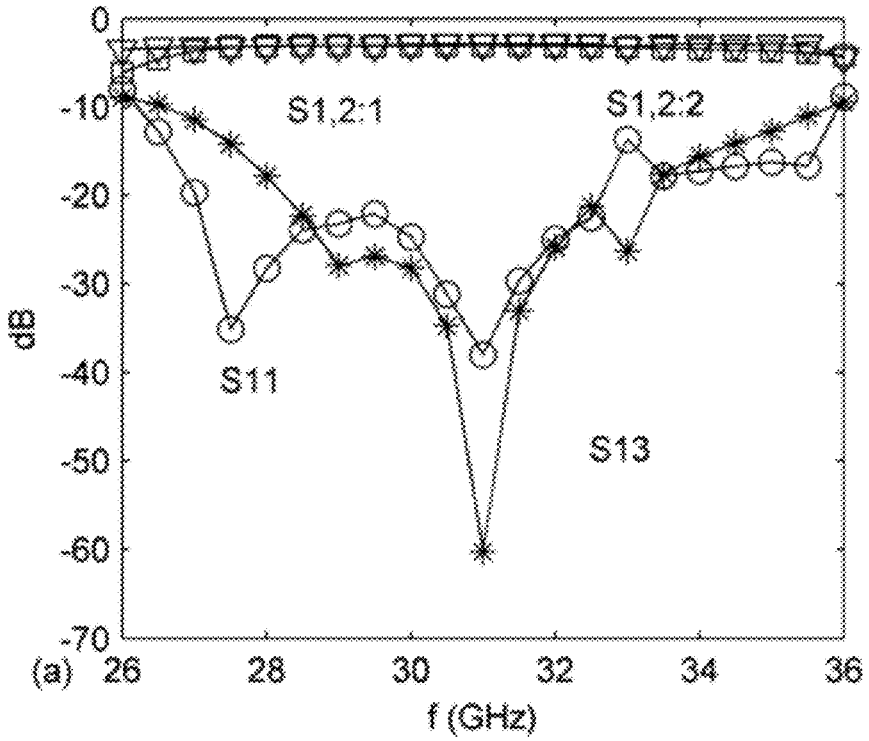
FIGS. 12A-12B show (FIG. 12A) the optimized S parameters and (FIG. 12B) the phase differences of the two orthogonal $TE_{11}$ modes of the circular polarizer at Port 1, according to one embodiment of the invention.
Figure 12B:
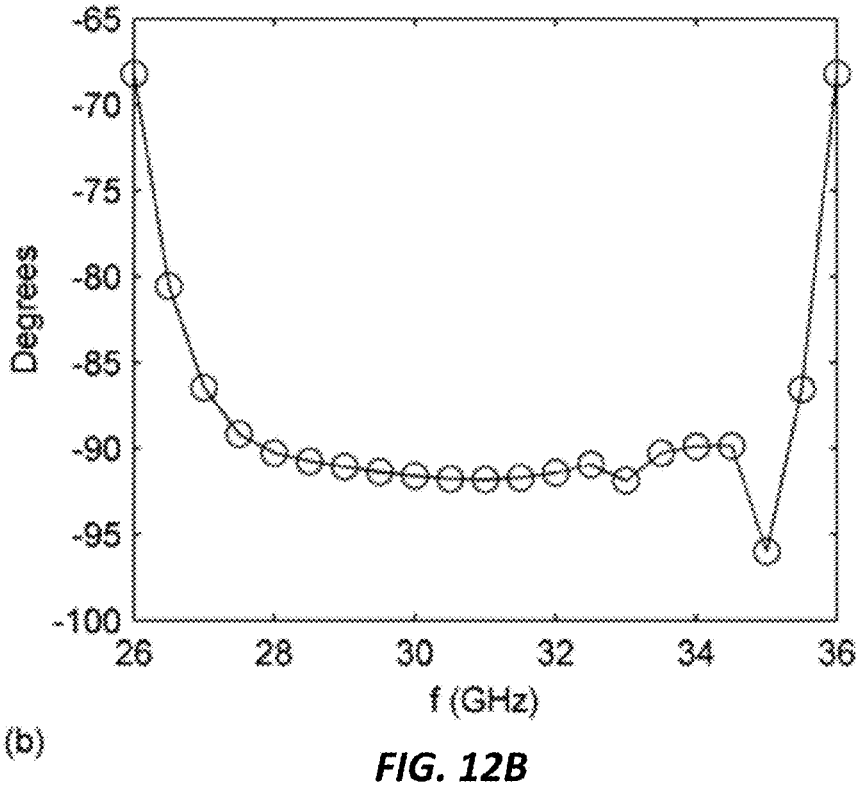
Figure 13:
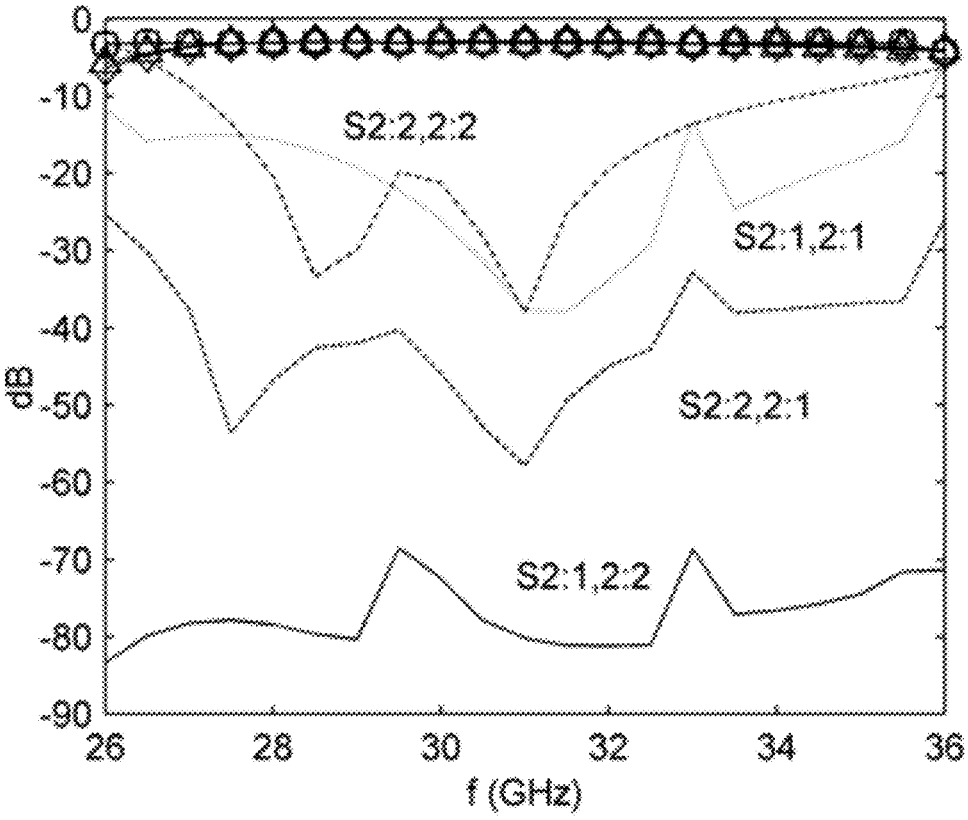
FIG. 13 shows the optimized S parameters of the circular polarizer with regard to Port 2 (the solid line S(2:1; 2:2), the dashed blue S(S(2:2; 2:1)), the dashed-dotted line S(S(2:2; 2:2)), the dotted line S(2:1; 2:1), the diamond, circular, rectangular, and triangular lines S(2:1; 1), S(2:2; 1), S(2:1; 3), and S(2:2; 1), according to one embodiment of the invention.

The results in FIGS. 12A-12B show that the return loss and isolation between the rectangular ports is below −10 dB and the phase differences of the two orthogonal $TE_{11}$ modes maintains in the vicinity of 90° within a bandwidth of about 30%, the detailed parameters of the polarizer is shown in Table 1. From FIG. 13, the isolation between the two orthogonal $TE_{11}$ modes is lower −40 dB, and the $TE_{11}$ power is equally divided between Port 1 and Port 3, i.e., S(2:1; 1)=S(2:2; 1)=S(2:1; 3)=S(2:2; 1)=−3 dB. For the same phase of two $TE_{11}$ modes, there are respectively 90° and −90° phase differences between the two modes in Port 1 and Port 2, i.e., Arg(S(2:1; 1))−Arg(S(2:2; 1))=90°, and Arg(S(2:1; 3))−Arg(S(2:2; 3))=−90°. For a LHCP (or RHCP) wave, Arg(S(2:1; 1))−Arg(S(2:2; 1))=180° (or 0°), and Arg(S(2:1; 3))−Arg(S(2:2; 3))=0° (or)−180°, thus, only one specific rectangular port outputs power and the other one is isolated.

Figure 14A:
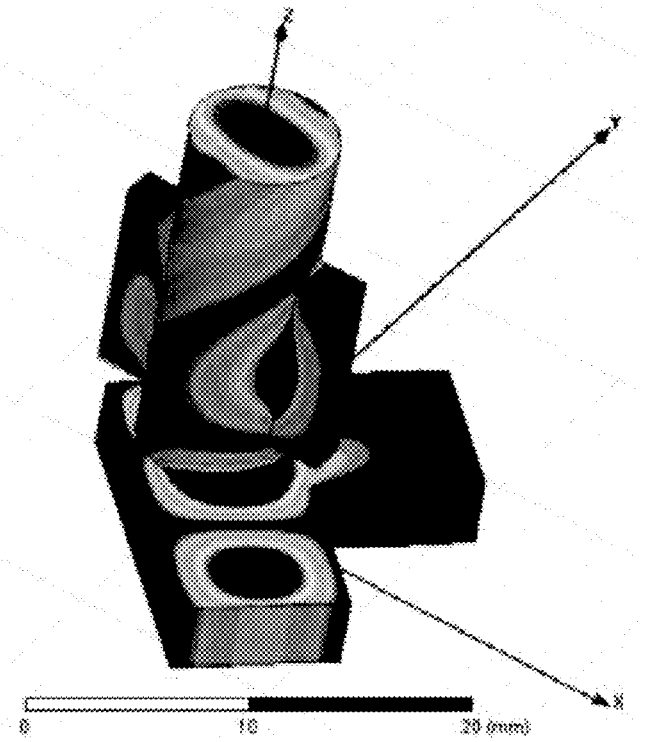
FIGS. 14A-14C show the snapshot electric field on the surface of the circular polarizer.
Figure 14B:
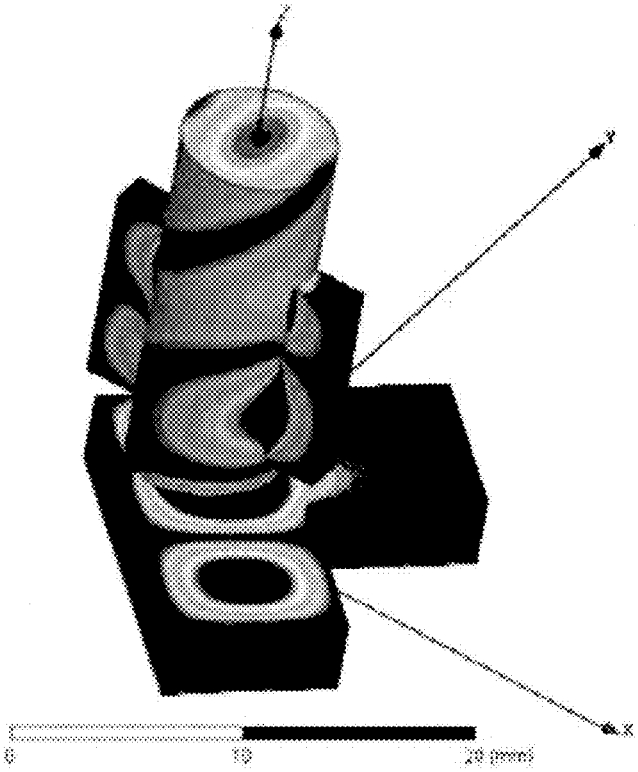
Figure 14C:
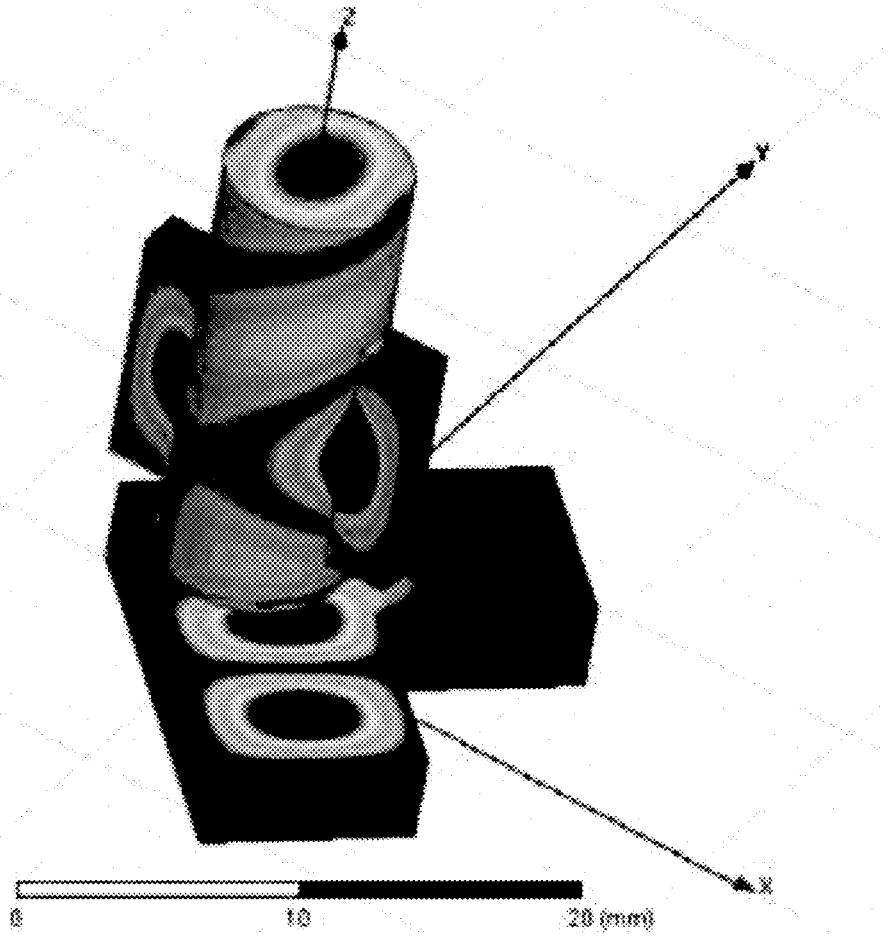

The transient electric field in FIGS. 14A-14C show that the circular polarized wave from circular waveguide propagates in one rectangular port, and the other rectangular port is isolated. Using only a pair of grooves to realize the broadband circular polarizer has several benefits, including simplification of the design and optimization course, and decreasing the manufacture cost. In addition, this design is suitable for high frequency applications, such as Ka-band and W-band.

TABLE 1

The optimized parameters of the structure (unit in millimeter).

| Rectangular waveguide | | Circular waveguide | Cylinder Step | | | |
|---|---|---|---|---|---|---|
| | | | Radius | Height | Location | Location |
| Width | Height | Radius | $R_1$ | $Z_1$ | $X_1$ | $Y_2$ |
| 7.96 | 3.455 | 3.5 | 2.5 | 1 | −0.15 | 0 |

| Pin | | | | Groove | | |
|---|---|---|---|---|---|---|
| Radius | Height | Location | Location | | | |
| $R_2$ | $Z_2$ | $X_2$ | $Y_2$ | height | Depth | Width |
| 0.5 | 1.3 | 0.275 | 0.8 | 9.85 | 2.51 | 1.75 |

A couple of dual circular polarizers with the material of brass have been manufactured, and each includes three pieces: one bottom block, and two top left and right blocks. The bottom and top blocks are split along the centerline of the waveguide, and the circular step and the two pins are located at the bottom block; the top two blocks split the grooves into two equal halves. This compact circular polarizer has an inner volume smaller than $1.5\lambda^3$, and the outer metal block is 1 $inch^3$.

Figure 15:
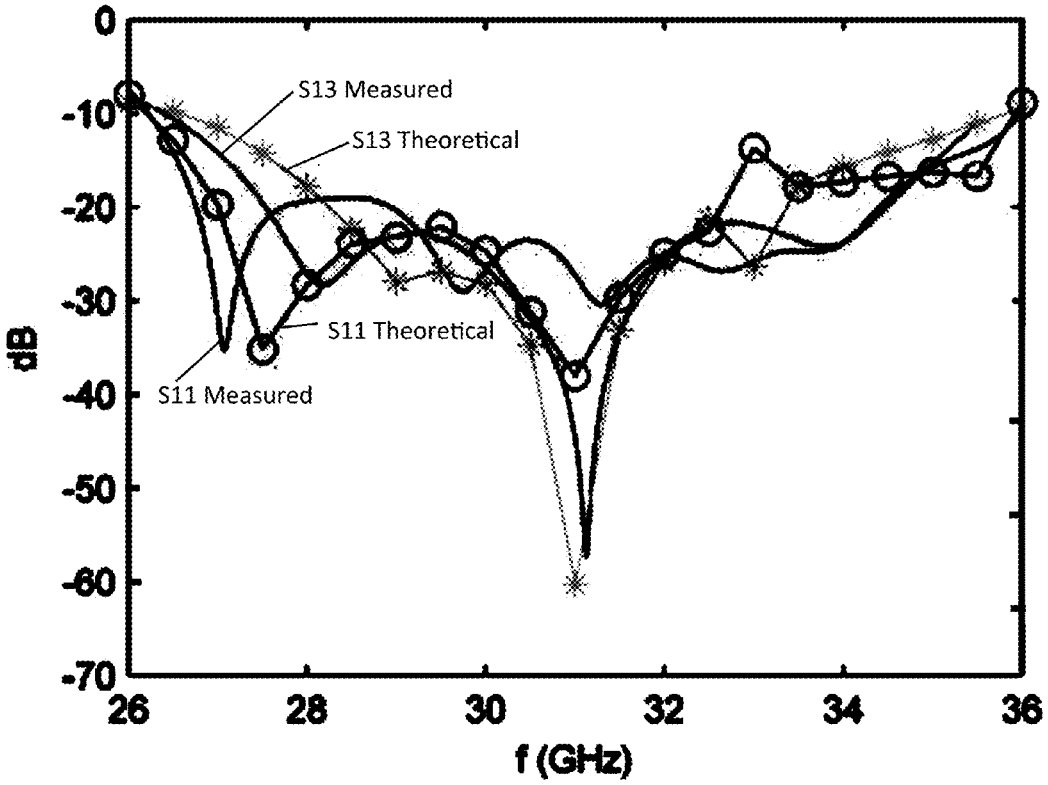
FIG. 15 shows a comparison of the measured and theoretical return loss S11 and isolation S13, according to one embodiment of the invention.

Agilent E8364B PNA Network Analyzer is used to measure the S parameters. Two polarizers are connected back to back with a circular waveguide, when two coaxial to WR28 waveguide adapters are used to link the inputs of one polarizer with the PNA, and two Ka-band terminations are combined with the inputs of the other polarizer to measure the return loss and isolation. The experimental turn loss and isolation is basically consistent with the simulation result, as illustrated in FIG. 15. The bandwidth for return loss <−15 dB and isolation <−15 dB is 26%.

Figure 16A:
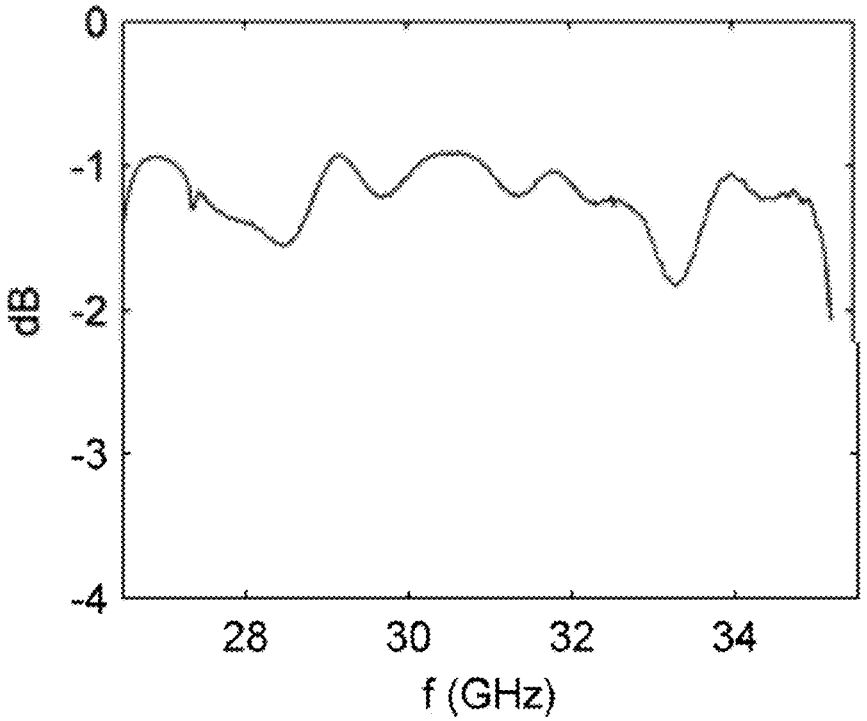
FIGS. 16A-16C show (FIG. 16A) the measured transmission coefficient (twice of the insertion loss) and (FIG. 16B) the output of one rectangular port by successively rotating one polarizer with 0°, 90°, 180°, and 270° and (FIG. 16C) the axial ratio, according to one embodiment of the invention.
Figure 16B:
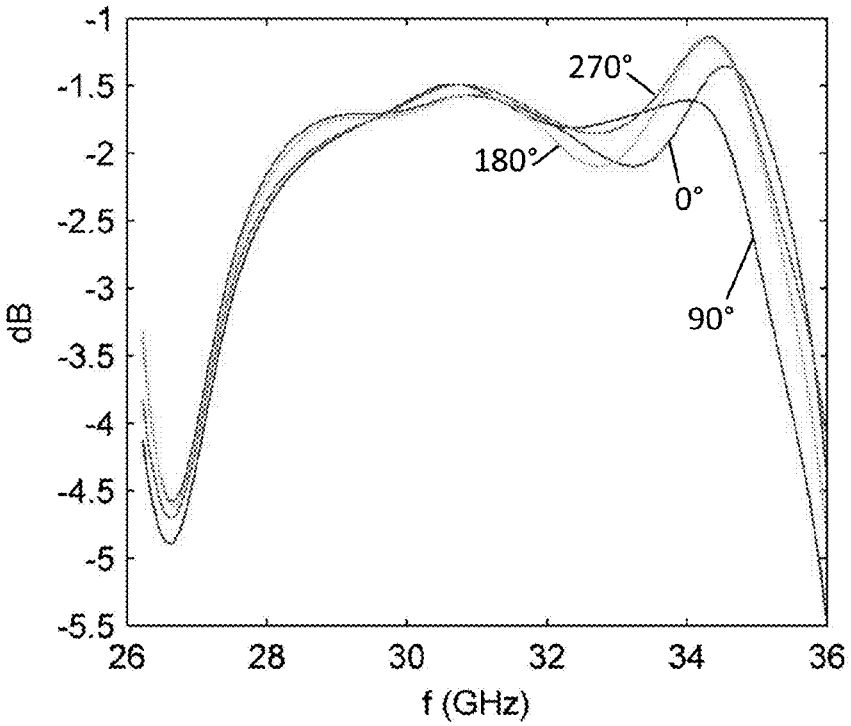
Figure 16C:
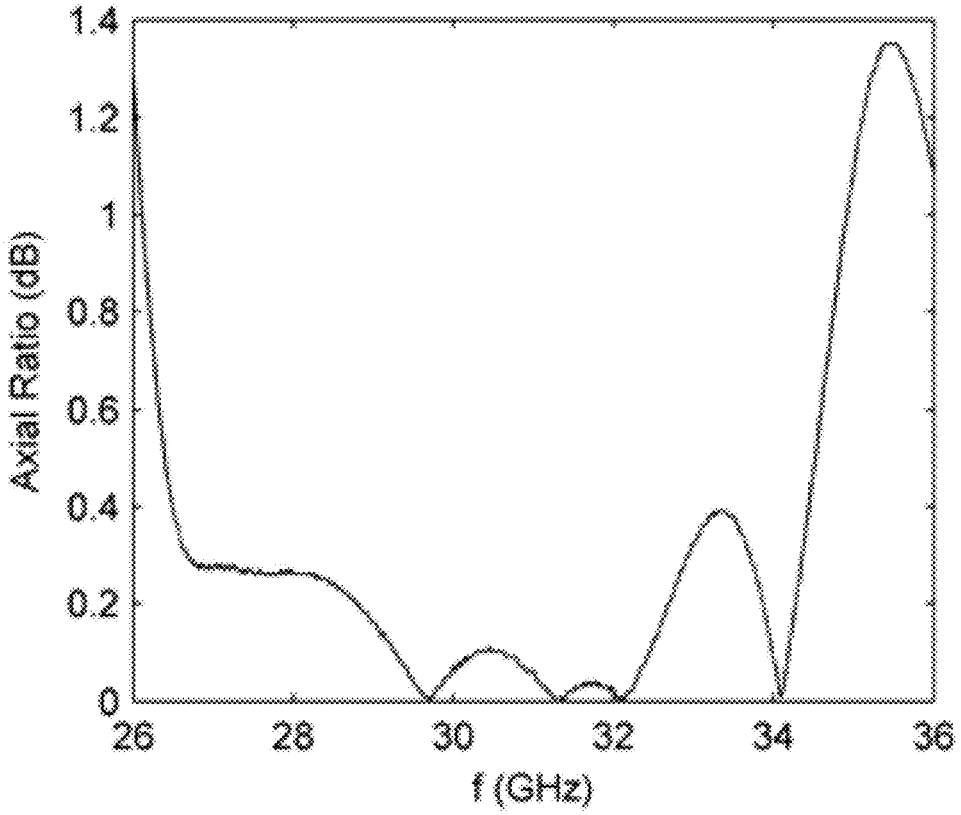

When a linear polarizer wave is incident in one rectangular port of the polarizer, a LHCP wave is generated and outputted at the circular port. By placing a short metal plane at the circular port, the polarization of incident LHCP changes to RHCP after reflection, thus, the other rectangular port receives the signal, which shows one method to measure the insertion loss of the polarizer, as shown in FIGS. 16A-16C. Twice of the averaged insertion loss is about −1:2 dB.

In order to measure the circular polarization, two polarizers are jointed back to back with a circular waveguide, one adapter and one load are connected with one polarizer, the output of the LHCP from one polarizer changes to LP after the second polarizer, and further outputs in one rectangular port, with the other rectangular port isolated. Then, by rotating one of the polarizer successively by 0°, 90°, 180°, and 270°, the outputs of one rectangular port are shown in FIG. 16B. The axial ratio (AR) of the polarizer shown in FIG. 16C means the bandwidth for AR<0:5 dB is about 25%.

Before designing this polarizer, a septum dual circular polarizer at W-band was build, whose performance was not very good with a bandwidth <30%, and the limited bandwidth may be came from the non-perfect design. Then, we try to build a more broadband polarizer, although the bandwidth of the new polarizer is not wider than the septum polarizer.

Presented and tested is an embodiment of a dual circular polarizer that is compact, broadband, and easy to manufacture. The total volume of the polarizing diplexer is smaller than $1.52\lambda^3$ and the bandwidth is about 25%. The design uses simple shapes, so it should be easy to manufacture. Due to the compact size and wide bandwidth, this polarizer can be used in a wide range of applications, including detectors of the CMB.

Satellite broadcasting, communicating, and tracking systems generally operate with circular polarization in circular waveguides so as to realize polarization compatibility of reception and transmission, since the received RF signal could be arbitrary linear polarized wave (LP), RHCP and/or LHCP. Thus, a circular polarity converter and a separator are needed, whose crucial design points are to convert the linearly polarized mode into two orthogonal modes with a 90-degree phase shift, and to keep good isolation between two input ports and small return loss. Further, for megawatt power level for medical accelerator and linear accelerators in high-energy research, there is still no compact and high-power capacity phase shifter.

According to further embodiments of the invention, two kinds of for compact waveguide circular polarizers are further presented. One embodiment includes an H-plane T junction of rectangular waveguide, one circular waveguide as an E-plane arm located on top of the junction, the center circular stub, dome or pins are used to isolate the two rectangular ports and match the structure, as well as realizing the mode conversion and 90 deg phase difference of the two orthogonal $TE_{11}$ modes together with the T-junction rectangular stub. The optimized polarizer has the advantages of a very compact size with a volume smaller than $0.6\lambda^3$, low complexity, and high power capacity.

Another embodiment includes two rectangular waveguides with a perpendicular H-plane junction, one circular waveguide coupled in E-plane, and a pair of large grooves in the circular waveguide. A cylindrical step and two pins or domes can be used to isolate the two rectangular ports and match this structure. The dual circular polarizer has a volume smaller than $1.5\lambda^3$, broad bandwidth ~20%, high power capacity.

There are several important applications for these two embodiments, firstly, simultaneously receiving and transmitting right-hand and left-hand circularly polarized waves used for communications and polarization transition both for low power and high power microwave domain; secondly, by adding an electronic-controlled movable short circuit in the circular waveguide, it becomes the most compact and fast-action waveguide phase shifter and can be used for medical accelerator and most application case for high-power phase shifter.

The embodiments relate to compact microwave circular polarizers for spontaneously receiving and transmitting right hand and left hand circular polarized wave (RHCP and LHCP) both for low power and high power microwave domain.

By adding an electronic-controlled movable short circuit in the circular waveguide and adjusting the plunger position with λ, the dual polarizer becomes the most compact waveguide phase shifter and can be used for medical accelerator and most application case for high-power phase shifter. The phase shifter is much smaller, reduced complexity, and higher capacity compare to the existed high-power phase shifter realized by inserting yttrium-Iron Garnet (YIG) and ferroelectric material and so on.

The structure according to the current embodiments can be adopted in varied frequency from S-band to W-band because of realizable manufacture.

By adding an movable short circuit in the circular waveguide and electronic-controlled adjusting the piston position, the dual polarizer becomes the most compact, and fast-action waveguide phase shifter and can be used for medical accelerator and most application case for high-power phase shifter.

One embodiment of the dual polarizer includes an H-plane T junction of rectangular waveguide, one circular waveguide as an E-plane arm located on top of the junction, the center circular stub, dome or pins are used to isolate the two rectangular ports and match the structure, as well as realizing the mode conversion and 90° phase difference of the two orthogonal $TE_{11}$ modes together with the T-junction rectangular stub. The schematic structure is shown in the FIGS. 17A-17B.

Turning now to the design of the S-matrix for the dual circular polarizer:

$$S = \frac{\sqrt{2}}{2}\begin{pmatrix} 0 & 1 & i & 0 \\ 1 & 0 & 0 & -1 \\ i & 0 & 0 & i \\ 0 & -1 & i & 0 \end{pmatrix}$$

Figure 18A:
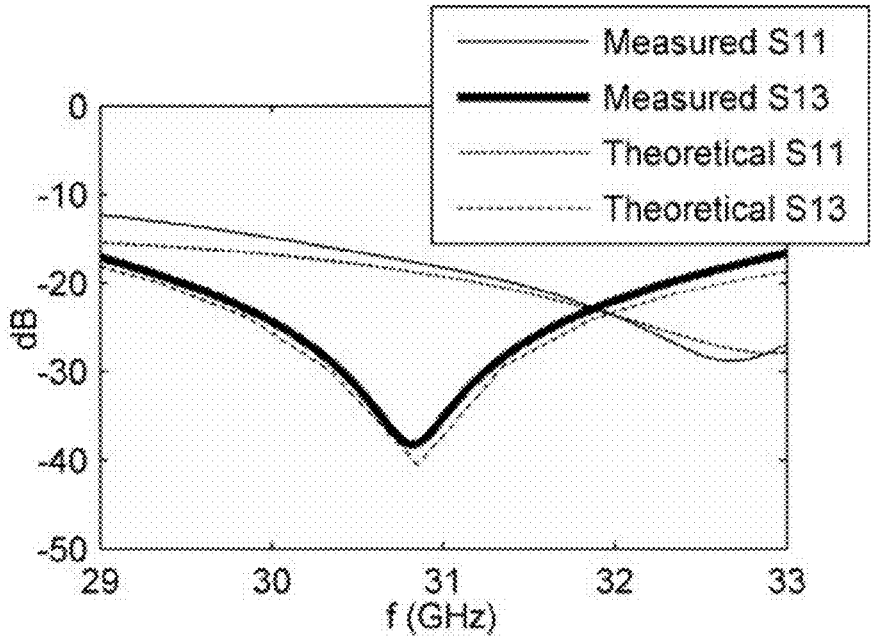
FIGS. 18A-18B show (FIG. 18A) a comparison of the measured and theoretical return loss $S_{11}$ and isolation $S_{13}$ (FIG. 18B) the output of one rectangular port for back-to-back jointed polarizers by successively rotating one polarizer with 0°, 90°, 180°, and 270°, according to one embodiment of the invention.

In an example embodiment of a dual polarizer for 30 GHz, the theoretical and experimental S parameters are compared in FIG. 18A.

Figure 18B:
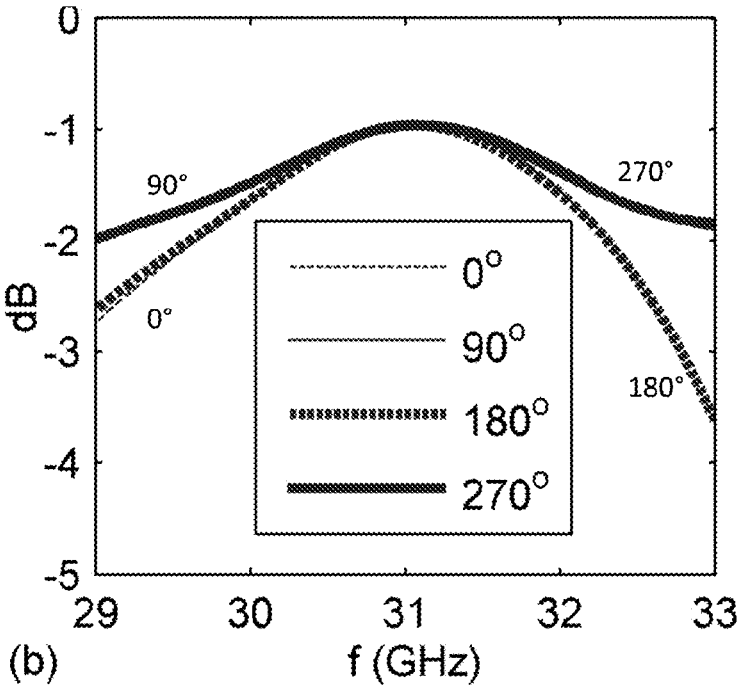

In order to measure the circular polarization, two polarizers are jointed back to back with a commercial circular waveguide plated by gold, one adapter and one load are connected with one polarizer. The output of the LHCP from one polarizer changes to LP after the second polarizer, and further outputs in one rectangular port, with the other rectangular port isolated. Then, by rotating one of the polarizer successively by 0°, 90°, 180°, and 270°, the outputs of one rectangular port are shown in FIG. 18B representing the circular polarizer wave.

The optimized parameters of the Ka-band septum polarizer are illustrated in Table 2, where standard rectangular waveguide WR28 is used in order to conveniently match and connect with other microwave devices. The circular waveguide has a small radius to cut off $TM_{01}$ mode.

TABLE 2

The optimized parameters of the septum polarizer for Ka-band (unit in millimeter).

| Rectangular waveguide | | Stub | | Circular waveguide | Cylinder Pins | | | |
|---|---|---|---|---|---|---|---|---|
| $W_r$ | $H_r$ | $W_s$ | $L_s$ | $R_c$ | $R_1$ | $Z_1$ | $R_2$ | $Z_2$ |
| 7.44 | 3.46 | 8.05 | 2.5 | 3.55 | 2.02 | 0.92 | 0.37 | 2.85 |

Figure 17A:
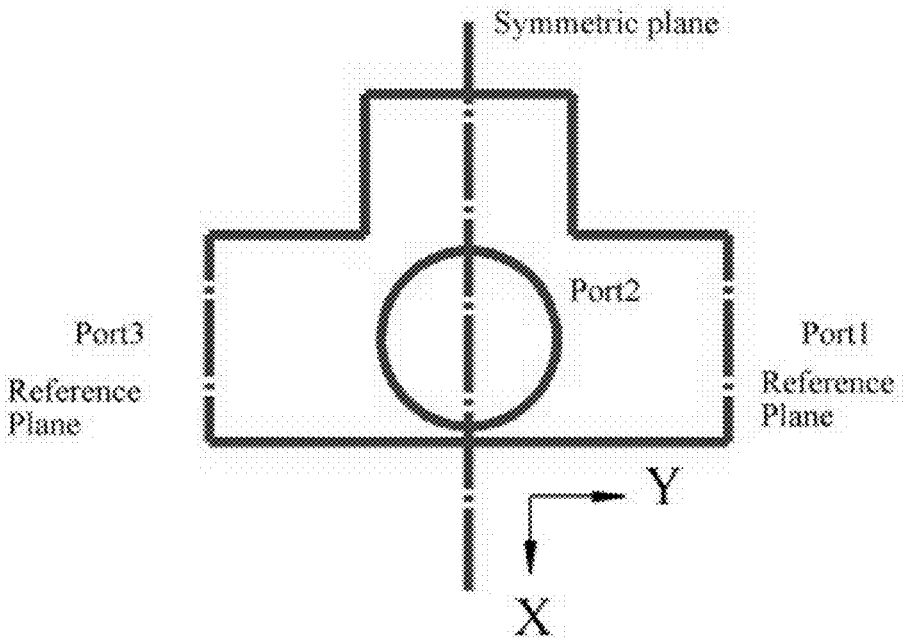
FIGS. 17A-17B show (FIG. 17A) a schematic drawing of the dual circular polarizer (FIG. 17B) the transient field distribution for the compact dual circular polarizer, according to one embodiment of the invention.
Figure 17B:
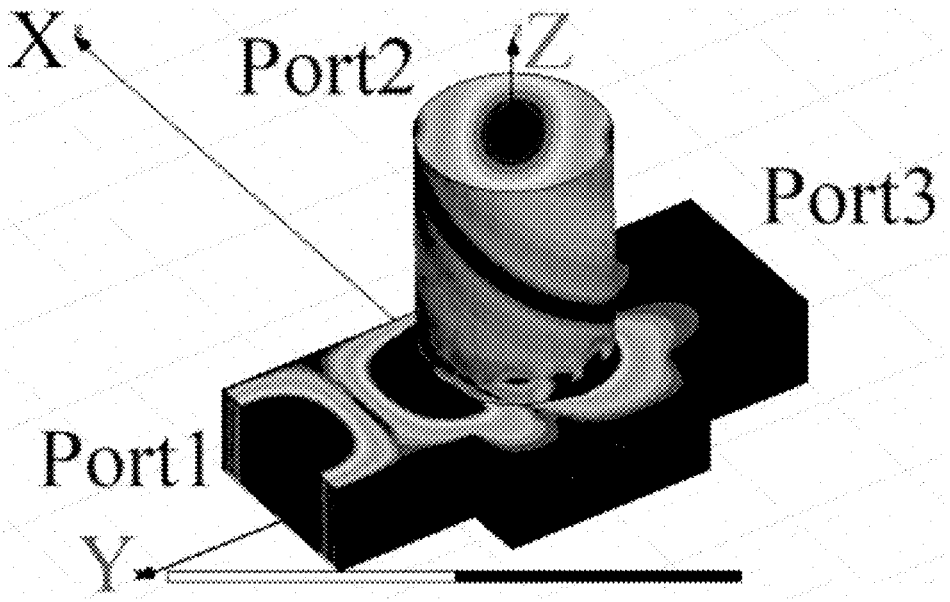

For the dual circular polarizer with three physical ports and four modes, as illustrated in FIG. 17A, its special S-Matrix is disclosed. There is only one symmetric plane for a non-zero stub-arm length. The eigenvectors of the S-matrix of the 4-modes network are denoted by a column vector $[a, b, c, d]^T$, where a, b, c, and d are respectively the amplitudes of the wave in port 1, 2:1, 2:2, and 3. The modes Port 2:1 and Port 2:2 are respectively along Y and X-axis. Due to the electric and magnetic symmetry with regard to the dashed line, the four eigenvectors of the S-matrix can be written as $[1, b1, 0, -1]^T$, $[1, b2, 0, -1]^T$, $[1, 0. c1, 1]^T$, and $[1, 0, c2, 1]^T$. Owing to the orthogonal basis of eigenvectors, the dot product of every two eigenvector should be zero, thus, $b1\times b2=-2$, and $c1\times c2=-2$. It is possible to choose the position of the reference planes in such a way that $b1=c1=\sqrt{2}$, and then, $b2=c2=-\sqrt{2}$.

The normalized orthogonal Matrix of eigenvectors X is $$X = \frac{1}{2}\begin{pmatrix} 1 & 1 & 1 & 1 \\ \sqrt{2} & -\sqrt{2} & 0 & 0 \\ 0 & 0 & \sqrt{2} & -\sqrt{2} \\ -1 & -1 & 1 & 1 \end{pmatrix}$$

Since a 4 ×4 S-matrix is diagonalizable if and only if the sum of the dimensions of the eigenspaces is 4, or equivalently, if and only if S has 4 linearly independent eigenvectors. Consequently, the S-Matrix of 4-port network can be diagonalizable by the orthogonal eigenvectors Matrix as, $$S = X\begin{pmatrix} \lambda_1 & 0 & 0 & 0 \\ 0 & \lambda_2 & 0 & 0 \\ 0 & 0 & \lambda_3 & 0 \\ 0 & 0 & 0 & \lambda_4 \end{pmatrix}X^{-1}$$

$X^{-1}$ is the inverse matrix of X, and $\lambda_i$, i=1, 2, 3, and 4 are the eigenvalues of the S-Matrix. By solving the above equation for S, there is $$S = \frac{1}{4}\begin{pmatrix} \sum\lambda_i & \sqrt{2}(\lambda_1-\lambda_2) & \sqrt{2}(\lambda_3-\lambda_4) & -\lambda_1-\lambda_2+\lambda_3+\lambda_4 \\ \sqrt{2}(\lambda_1-\lambda_2) & 2(\lambda_1+\lambda_2) & 0 & \sqrt{2}(\lambda_2-\lambda_1) \\ \sqrt{2}(\lambda_3-\lambda_4) & 0 & 2(\lambda_3+\lambda_4) & \sqrt{2}(\lambda_3-\lambda_4) \\ -\lambda_1-\lambda_2+\lambda_3+\lambda_4 & \sqrt{2}(\lambda_2-\lambda_1) & \sqrt{2}(\lambda_3-\lambda_4) & \sum\lambda_i \end{pmatrix}$$

The eigenvalues in the resulting equation for S can be addressed by realizing the function of the dual circular polarizer. For a wave incident with an unit power at Port 1, $a_1=[\mathbf{1}; \mathbf{0}; 0; 0]^T$, the output is a circular polarized wave, $b_1=S\cdot a_1=\sqrt{2}[0, 1, i, 0]2$. Besides, for equal incident power with the same phase from Port 1 and Port 3, $a_2=\sqrt{2}[1, 0, 0, 1]^T/2$, the symmetric plane at Port 2 is equivalent to a magnetic boundary, and only Port 2:2 is excited, corresponding to $b_2=S\cdot a_2=[0, 0, i, 0]^T$; for equal incident power with 180° phase difference from Port 1 and Port 3, $a_3=\sqrt{2}[1, 0, 1, -1]^T/2$=the symmetric plane at Port 2 is equivalent to a electric boundary, and only Port 2:1 is excited, corresponding to $b_3=S\cdot a_3=[0, 1, 0, 1]^T$ From the three input vector $a_{1,2,3}$, and the corresponding output vector $b_{1,2,3}$, the eigenvalues can be solved in the following equations, $$\Sigma\lambda_i=0\lambda_3+\lambda_4-\lambda_1-\lambda_2=0$$

$$\lambda_1-\lambda_2=2\lambda_1+\lambda_2=0$$

$$\lambda_3-\lambda_4=2_i\lambda_3+\lambda_4=0$$

By solving this equation, the eigenvalues for the dual circular polarizer are $\lambda_1=1$, $\lambda_2=-1$, $\lambda_3=i$, and $\lambda 4=-i$. And the Scattering-Matrix above can be simplified as, $$S = \frac{\sqrt{2}}{2}\begin{pmatrix} 0 & 1 & i & 0 \\ 1 & 0 & 0 & -1 \\ i & 0 & 0 & i \\ 0 & -1 & i & 0 \end{pmatrix}$$

Figure 19A:
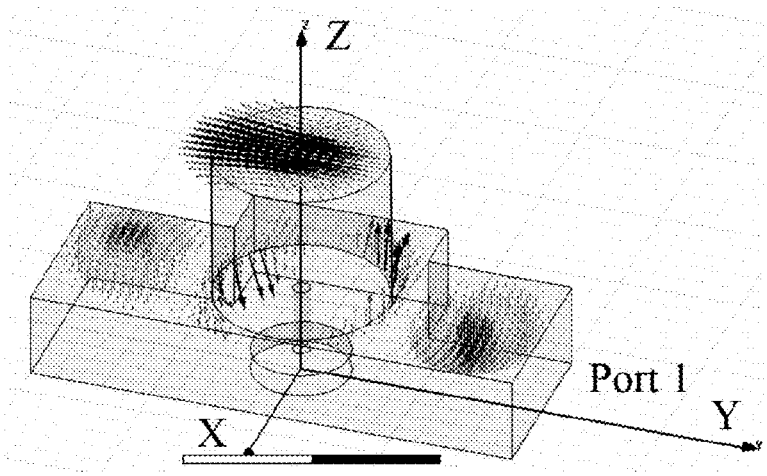
FIGS. 19A-19C show (FIG. 19A) the vector electric field and complex magnitude of surface field, (FIG. 19B) on top surface, and (FIG. 19C) on bottom for the equivalent symmetric electric boundary, according to one embodiment of the invention.
Figure 19B:
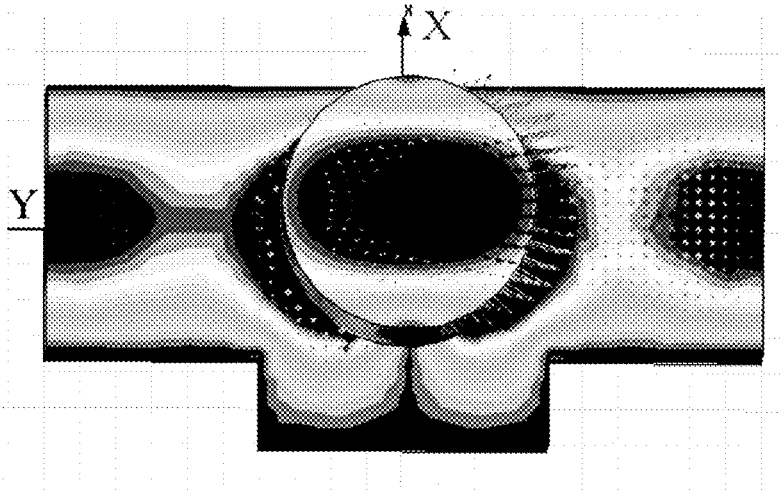
Figure 19C:
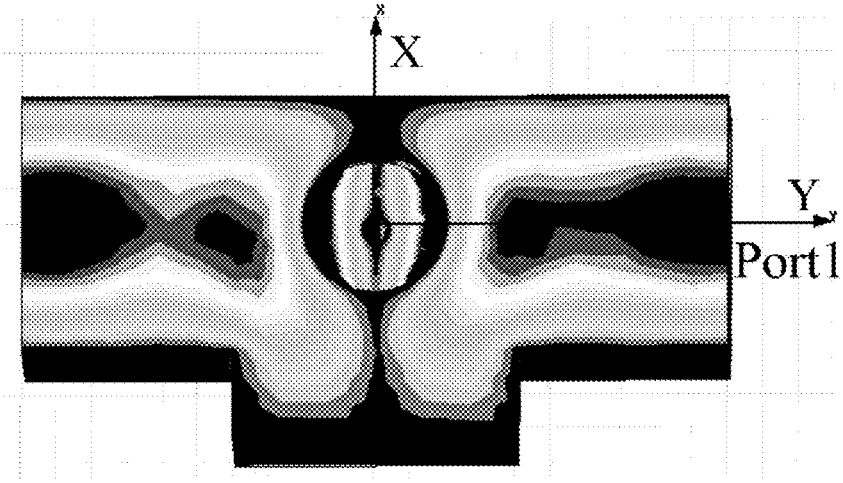

This S-matrix is the design goal for the dual circular polarizer, which needs the eigenvalues to satisfy $\lambda_1=-\lambda_2$, $\lambda_3=-\lambda_4$, and $\lambda_1=i\,\lambda_3$. The three key conditions can be achieved at the same time by tuning the two center pins and the stub. In more detail, by adjusting the height and radius of the dumpy pin and the slim pin, and the length and width of the stub, the polarizer can be obtained. The eigenvalues $\lambda_1=1$ and $\lambda_2=\lambda_1$ and the corresponding eigenvectors are $[1, \sqrt{2}, 0, -1]^T/2$ and $[1, -\sqrt{2}, 0, -1]^T/2$ are equivalent to the condition that the symmetric plane is equivalent to an electric boundary, which means that physically there are equal amplitude field with a 180° phase difference incident at port 1 and port 3, as illustrated in FIG. 19A. In this situation, the stub is cutoff and there is only evanescent wave in the stub, as shown in FIG. 19B; electric field on the slim pin is very small due to the slim pin located very close to the electric boundary, as shown in FIG. 19C. In HFSS simulation, by taking the symmetric plane as electric boundary, a two-physical-port and two-mode network is obtained and optimized, instead of studying the four-port polarizer. Thus, by tuning the dumpy pin, the two-port network is matched, and $\lambda_1=\lambda_2$ is realized in this situation.

Figure 20A:
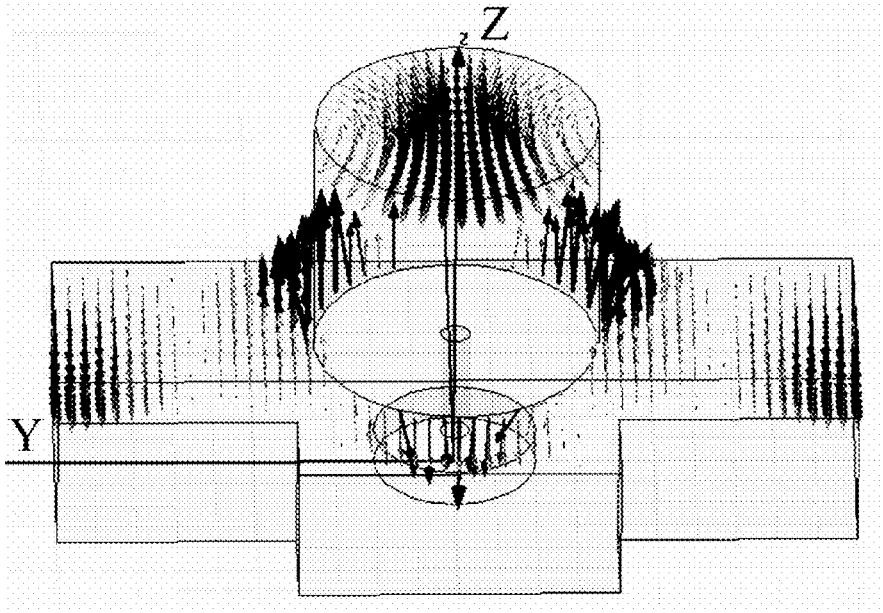
FIGS. 20A-20B show (FIG. 20A) the vector electric field and (FIG. 20B) complex magnitude on bottom surface for the equivalent symmetric magnetic boundary, according to one embodiment of the invention.
Figure 20B:
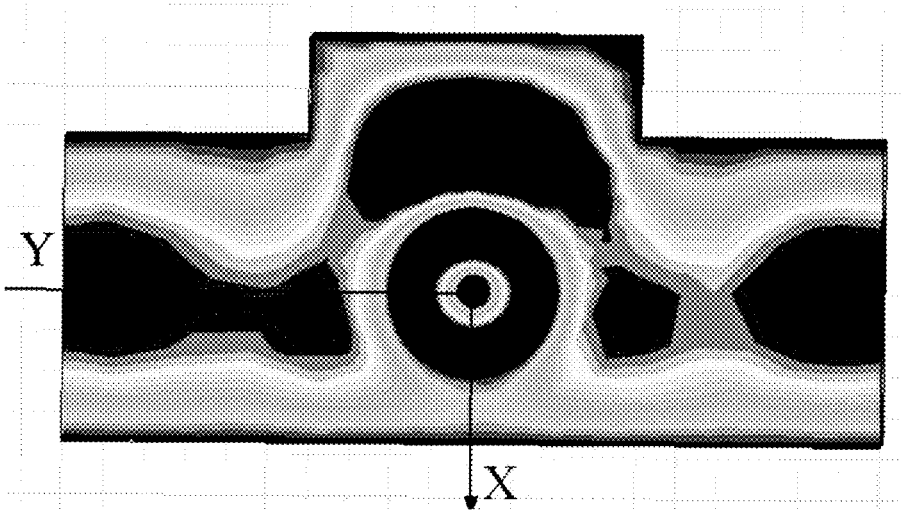

Similarly, the eigenvalues $\lambda_3=i$ and $\lambda_4=-i$ and the corresponding eigenvectors $[1, \sqrt{2}, 0, 1]^T/2$ and $[1, -\sqrt{2}, 0, 1]^T/2$ are equivalent to the symmetric plane as an magnetic boundary, which means that physically there are equal amplitude field with the same phase incident at port 1 and port 3, as illustrated in FIGS. 20A-20B. In HFSS simulation, by using the magnetic symmetric plane, a two-port network is obtained; and by adjusting the slim pin and the width and the length of the stub to realize $\lambda_3=-\lambda_4$ and $\lambda_1=i\,\lambda_3$, the mode Port 2:2 with the equal amplitude of Port 2:1 and a 90° phase difference can be realized. Thus, a circular polarizer wave for this structure is generated with the transient surface field shown in FIG. 17B.

Figure 21A:
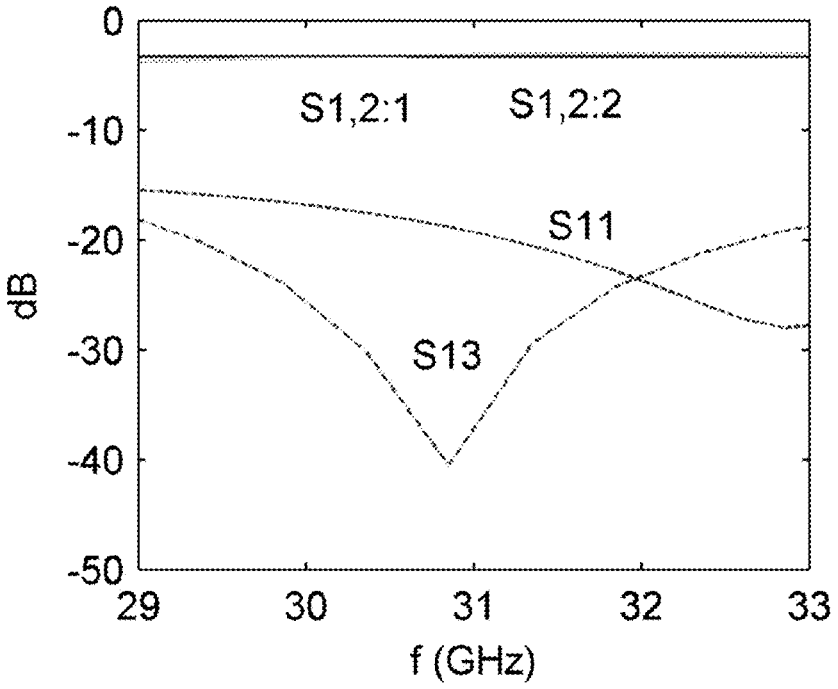
FIGS. 21A-21B show (FIG. 21A) S parameters of the dual polarizer; $S_{11}$ for return loss; $S_{1:2:1}$ and $S_{1:2:2}$ for transition to two orthogonal $TE_{11}$ modes; $S_{13}$ for isolation.
Figure 21B:
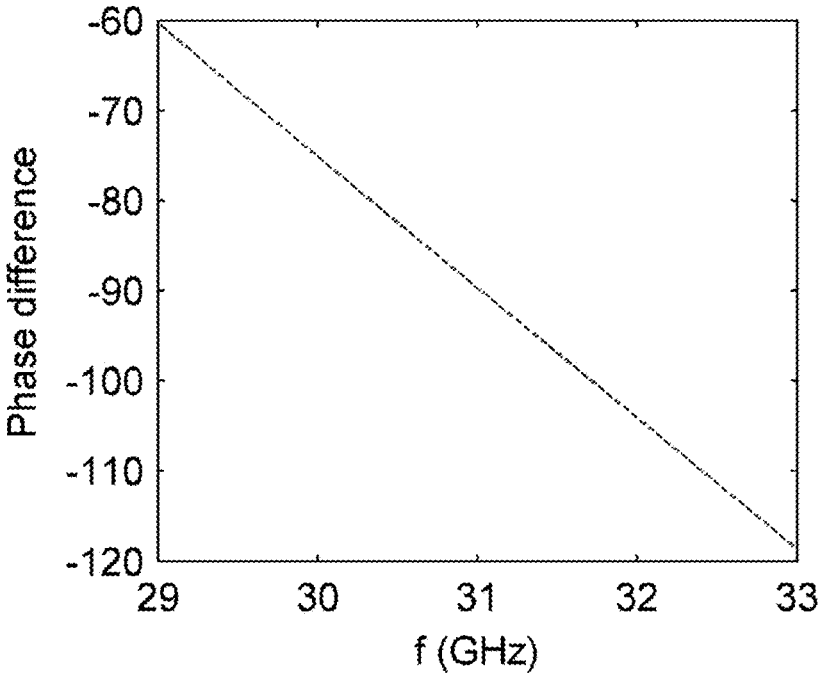

In order to increase the bandwidth, the dependence of propagation constant on frequency should be decreased. This can be achieved by broadening the width of the stub since β for a wider waveguide is less sensitive on frequency. Also, the path for exciting $TE_{11}$ mode 2 is from Port 1 to the stub and then to Port 2, which is longer than the path for generating $TE_{11}$ mode 1, thus, it is always sensitive to frequency. Widening the H-plane arm has the benefit of decreasing the path length for $TE_{11}$ mode 2, effectively reducing the difference between the two path lengths. The optimized S parameters of the polarizer given in FIGS. 21A-21B show that the two orthogonal $TE_{11}$ modes have relatively equal −3B amplitude, the isolation and return loss are respectively below −30 dB and −15 dB, and the phase difference between the two $TE_{11}$ modes varies of 60° from 29 GHz to 33 GHz. It should be emphasized that a pure circular wave requires a 90° differential phase between two orthogonal modes. As the frequency increases or decreases from the center frequency, the phase difference moves away from 90° leading to a decrease in the circularly polarized power. When this structure is used in the reverse way, the input RHCP and LHCP in circular Port 2 is respectively transformed into separated linear polarization in the two rectangular Ports 1 and 3. Thus, this device is a compact dual circular polarizer. Based on the above analysis, finally, the optimized parameter is shown in Table 5, which is also the same data of the manufactured polarizer. Note that the matched stub length $L_s$=2.5 mm is no long $1=4\lambda_g$, which is 3 mm for stub width $W_s$=8.05 mm and 3.2 mm for waveguide width $W_r$=7.44 mm.

Regarding manufacture tests, two pieces of dual circular polarizer with the material of brass have been manufactured, and the split-block design has been used to respectively fabricate the bottom and top block. The central circular step and pin are accurately built at the bottom block, and the H-plane arm as well as the rectangular and circular waveguides are located at the top block. This compact circular polarizer has an inner volume smaller than 0.6,3, and the outer metal block is 0.36 $inch^3$.

Agilent E8364B PNA Network Analyzer is used to measure the S parameters. In order to measure the return loss and isolation, two matched terminations are connected with the inputs of one polarizer, two coaxial to WR28 waveguide adapters are linked the inputs of the other polarizer with the VNA, and then, two polarizers are connected back to back with a circular waveguide. The experimental return loss and isolation are basically consistent with the simulation results, as illustrated in FIG. 18A.

Figure 22A:
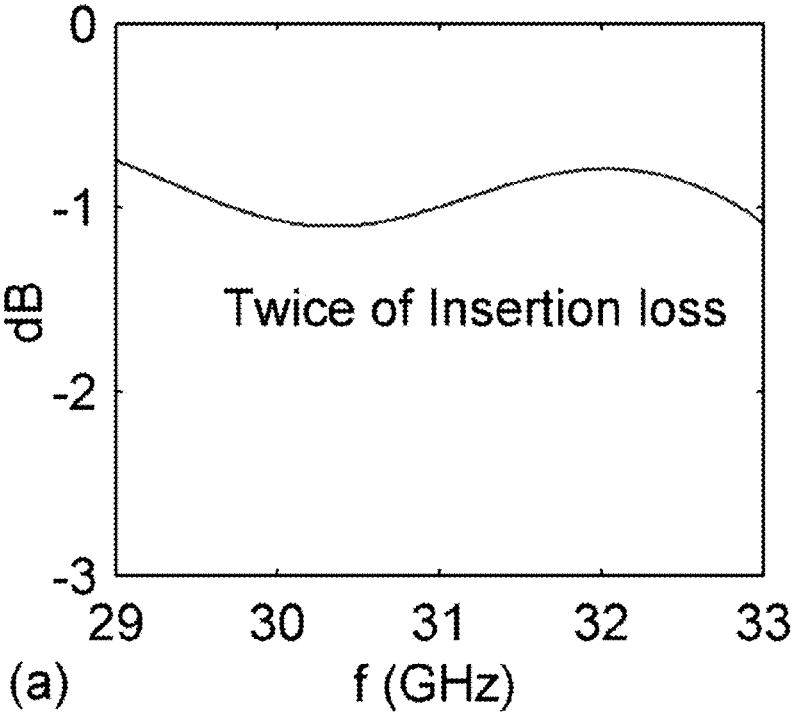
FIGS. 22A-22B show (FIG. 22A) twice of the insertion loss (see FIG. 18B for the output of one rectangular port), and (FIG. 22B) the output of the other rectangular port for back-to-back jointed polarizers by successively rotating one polarizer with 0°, 90°, 180°, and 270°, according to one embodiment of the invention.

The second step is to measure the insertion loss of the polarizer. When a linear polarizer wave is incident in Port 1 of the polarizer, a LHCP wave is generated and outputted at the circular Port 2. By placing a short metal plane at the Port 2, the polarization of incident LHCP changes to RHCP after reflection, thus, the Port 3 receives the signal, and the transmission coefficient of one polarizer is shown in FIG. 22A, where twice of the averaged insertion loss is about −1 dB.

Figure 22B:
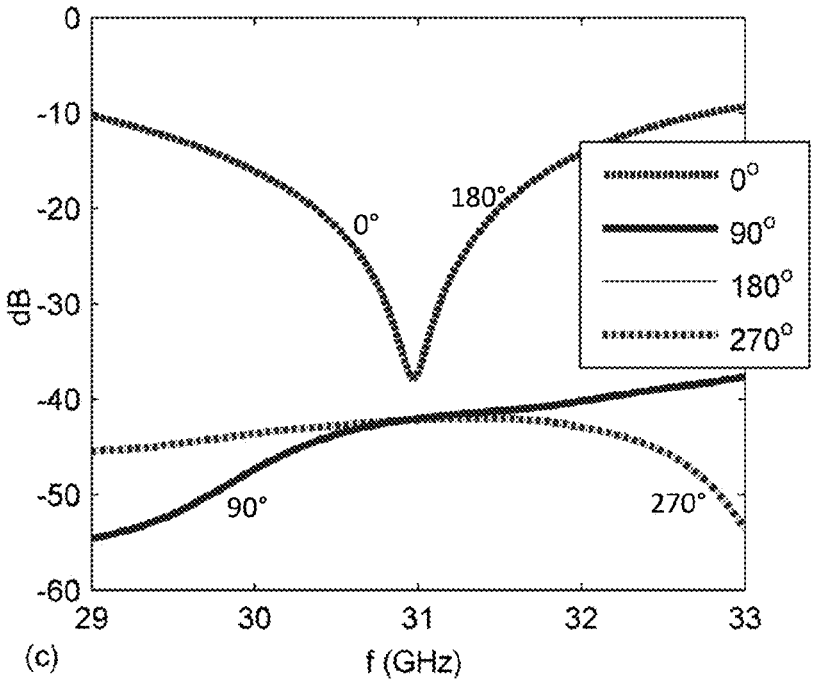

In order to measure the circular polarization, two polarizers are jointed back to back with a commercial circular waveguide plated by gold, one adapter and one load are connected with one polarizer, the output of the LHCP from one polarizer changes to LP after the second polarizer, and further outputs in one rectangular port, with the other rectangular port isolated. Then, by rotating one of the polarizer successively by 0°, 90°, 180°, and 270°, the outputs of one rectangular port are shown in FIG. 18B representing the circular polarizer wave, and the output in the other port in FIG. 22B represents the cross polarization. It should be emphasized that the outputs in FIG. 18B and FIG. 22B are the results from one polarizer jointed to the other polarizer, for a single polarizer, the bandwidth of the output will be higher than those in FIG. 18B and FIG. 22B.

Figure 23A:
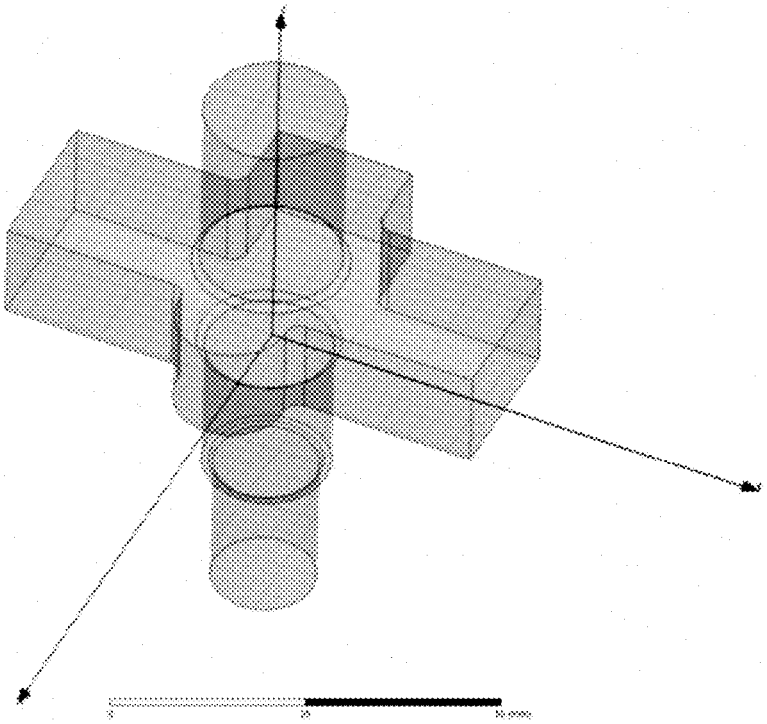
FIGS. 23A-23B show (FIG. 23A) the structure of the high power polarizer and (FIG. 23B) the transient surface field of the high power dual polarizer, according to one embodiment of the invention.
Figure 23B:
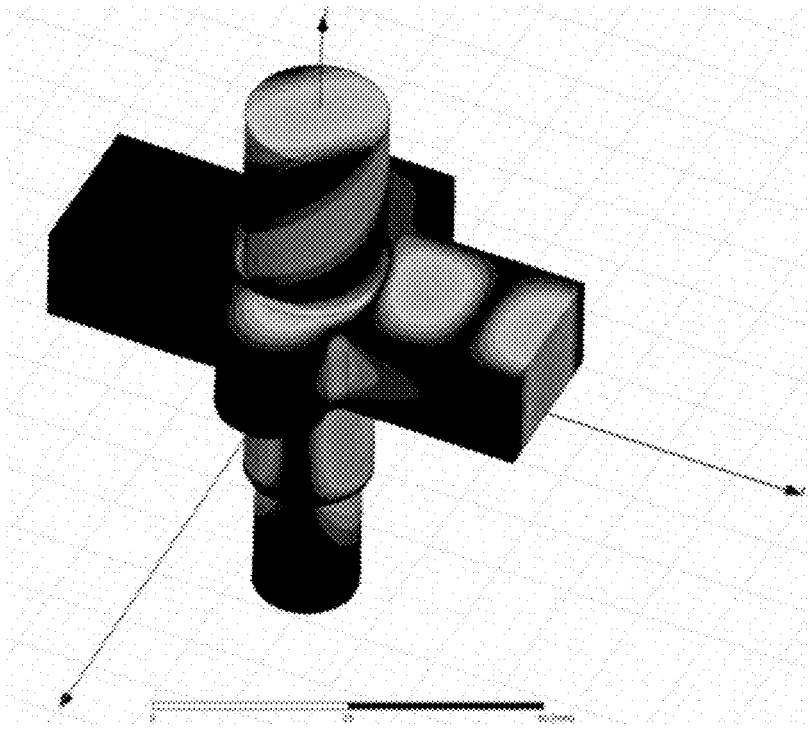

Turning now to the high power dual polarizer, by replacing the center pins to circular stubs, the high power dual circular polarizer could be realized as shown in FIGS. 23A-23B, and the S parameters for the high power dual polarizer is illustrated in FIG. 21A. For a high power application, the bandwidth of klystron source is very limited, thus, the bandwidth shown in FIG. 21A is enough for most of high power polarizer applications.

Figure 25:
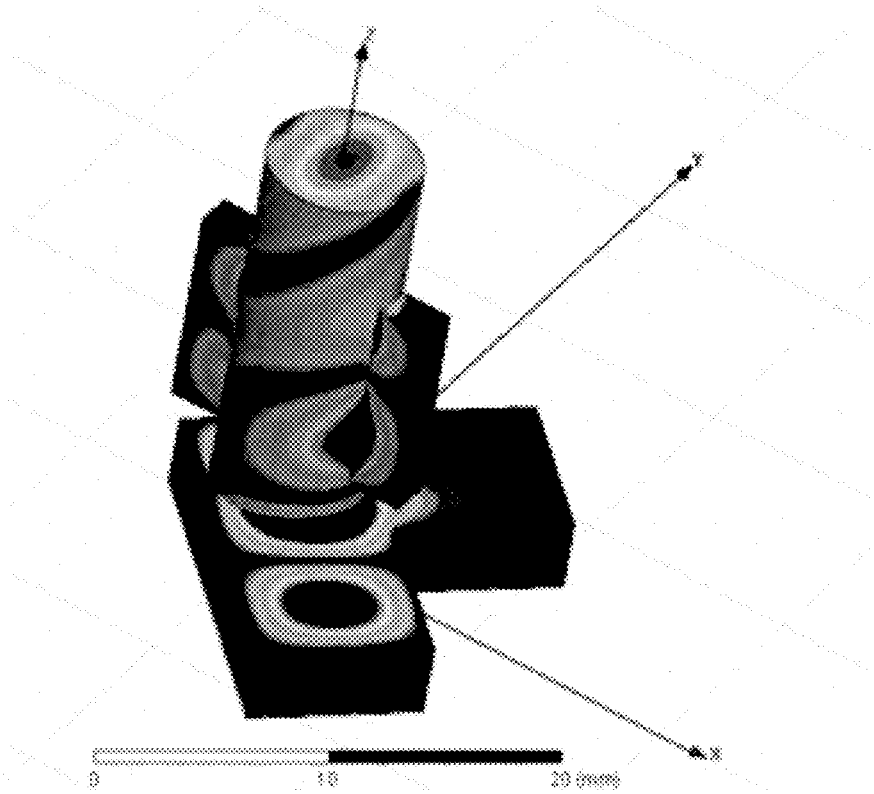

Regarding the second embodiment of the dual polarizer, the polarizer includes two rectangular waveguides with a perpendicular H-plane junction, one circular waveguide coupled in E-plane, and a pair of large grooves in the circular waveguide. A cylindrical step and two pins or domes can be used to isolate the two rectangular ports and match this structure. The dual circular polarizer has a volume smaller than $1.5\lambda^3$, broad bandwidth ~20%, high power capacity. The transient surface is shown in FIG. 25.

Figure 26A:
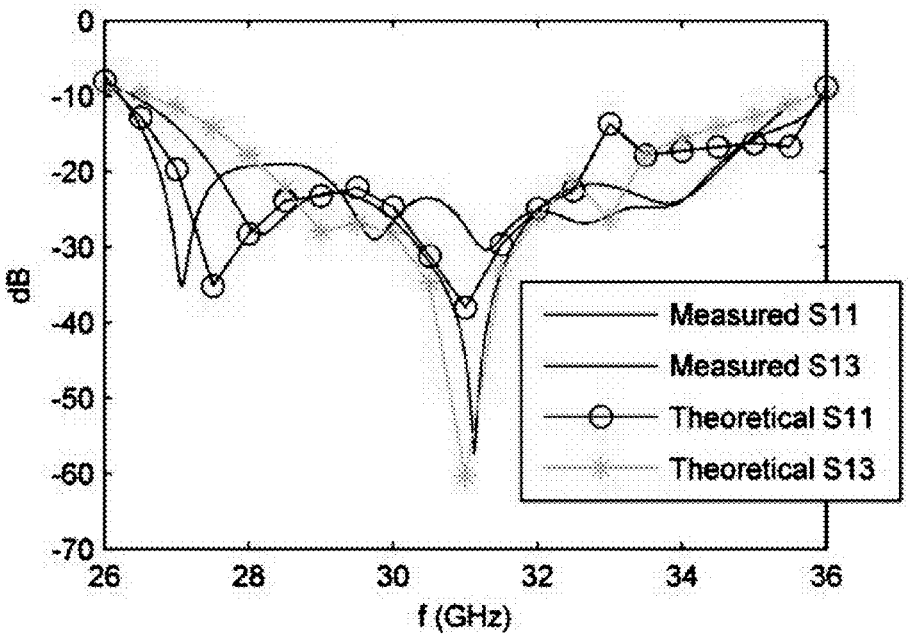
FIGS. 26A-26B show a comparison of the measured and theoretical return loss $S_{11}$ and isolation $S_{13}$, according to one embodiment of the invention.
Figure 26B:
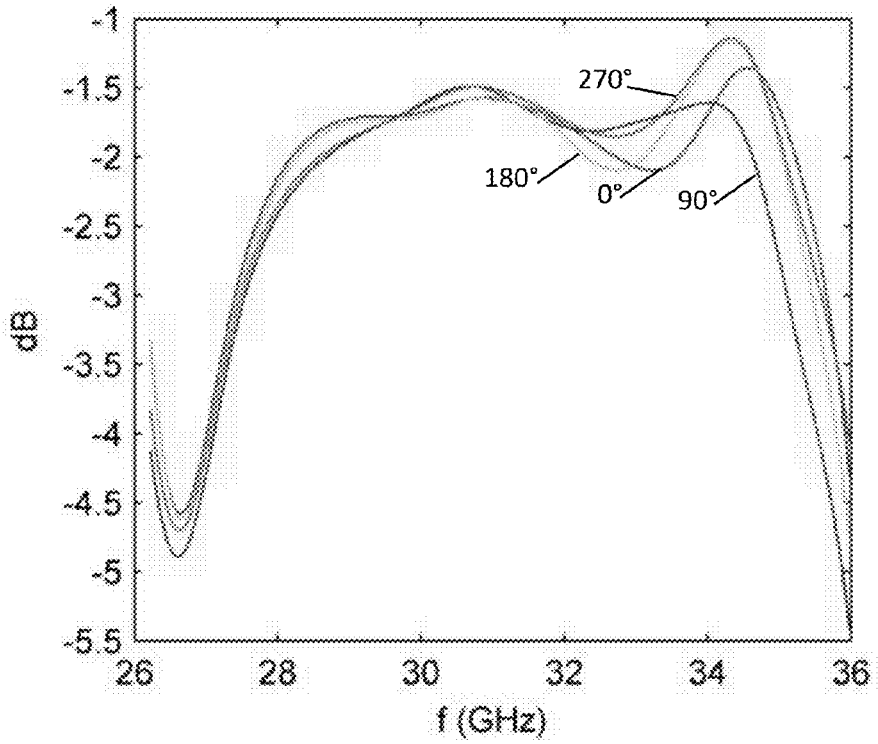

A couple of dual circular polarizer for central frequency 31 GHz with the material of brass have been manufactured, and each includes three pieces: one bottom block, and two top left and right blocks. The bottom and top blocks are split along the centerline of the waveguide, and the circular step and the two pins are located at the bottom block; the top two blocks split the grooves into two equal halves. This compact circular polarizer has an inner volume smaller than $1.5\lambda^3$, and the outer metal block is 1 $inch^3$. The experimental and theoretical turn loss and isolation is basically consistent with each other, as illustrated in FIGS. 26A-26B. The detailed dimension is shown in Table. 3.

TABLE 3

The optimized parameters of the structure (unit in millimeter) for central frequency 31 GHz.

| Rectangular waveguide | | Circular waveguide | Cylinder Step | | | |
|---|---|---|---|---|---|---|
| | | | Radius | Height | Location | Location |
| Width | Height | Radius | $R_1$ | $Z_1$ | $X_1$ | $Y_2$ |
| 7.96 | 3.455 | 3.5 | 2.5 | 1 | −0.15 | 0 |

| Pin | | | | Groove | | |
|---|---|---|---|---|---|---|
| Radius | Height | Location | Location | | | |
| $R_2$ | $Z_2$ | $X_2$ | $Y_2$ | height | Depth | Width |
| 0.5 | 1.3 | 0.275 | 0.8 | 9.85 | 2.51 | 1.75 |

Figure 24:
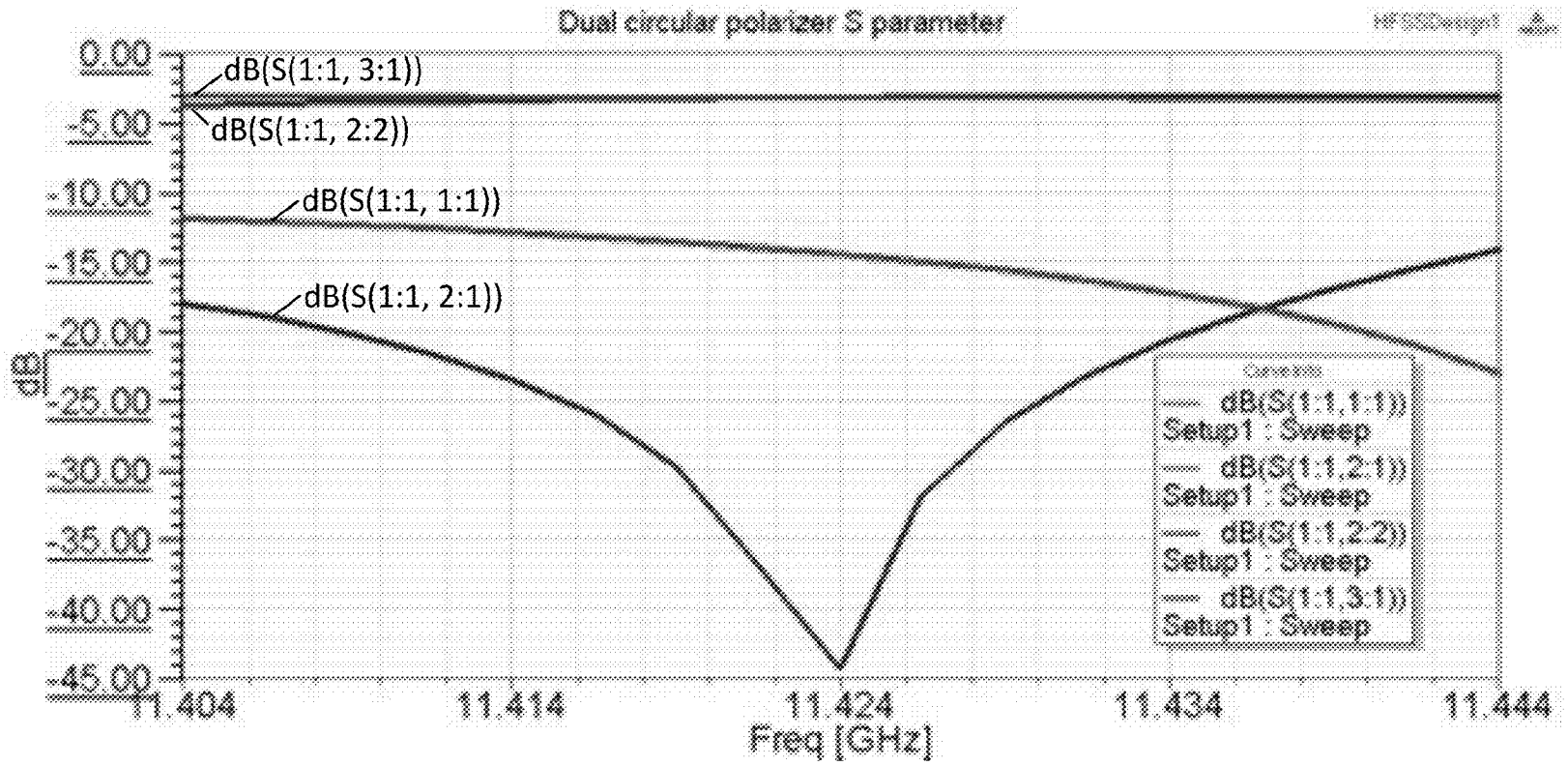
FIG. 24 shows the S parameters for the high power dual polarizer, according to one embodiment of the invention.
Figure 27A:
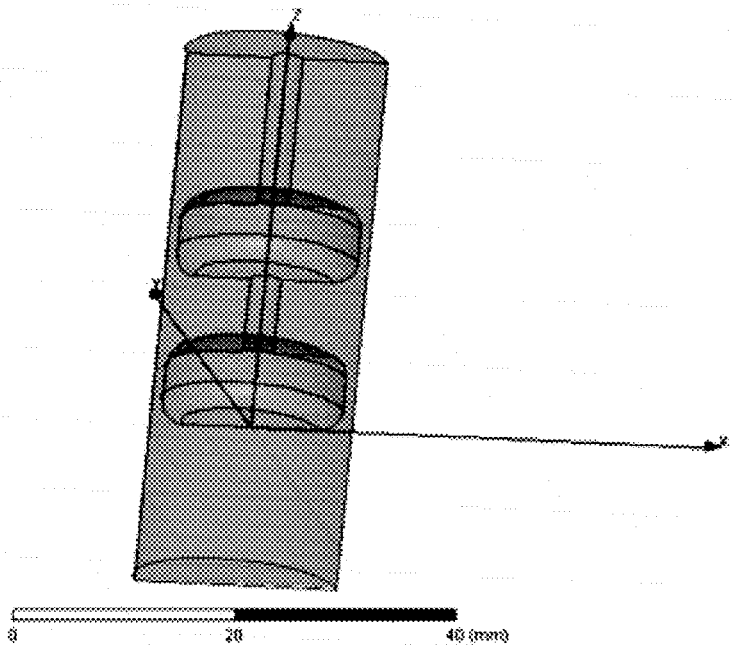
FIGS. 27A-27B show the structure and surface field of the plunger for compact phase shifter, according to one embodiment of the invention.
Figure 27B:
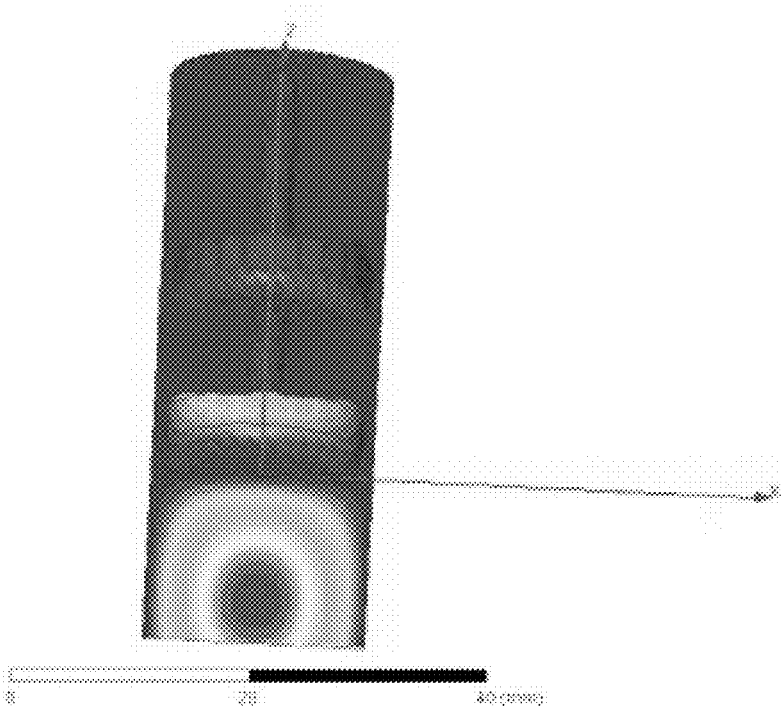

The current embodiment further includes a phase shifter, where by adding a movable short circuit in the circular waveguide and adjusting the piston position, the dual polarizer becomes the most compact, and, if the position is electronically controlled, fast-acting waveguide phase shifter. It can be used for ultra-high power applications, including but not limited to, microwave linear accelerators. The moving distance for the piston is $\lambda_g/2$ to realize a full 360° phase shift. The short circuit can be realized in a variety of forms, but most conveniently a chocked plunger with no contact to the walls as shown in FIGS. 27A-27B. The high power polarizer shown in FIGS. 23A-23B and FIG. 24 can be combined with the piston to realize the most compact phase shifter. When the plunger moves up and down, the output phase in the rectangular port of FIGS. 23A-23B will be changed according to the accurate position of the plunger. Of course, the polarizer in FIG. 25 connects with the plunger in FIGS. 27A-27B will become a compact low power phase shifter.

A further embodiment includes a hybrid for a dual mode pulse compressor. Here, this polarizer is essentially a four-port device and its scattering parameters are similar to that of a 90° hybrid. Hence, if one adds a RF spherical or cylindrical cavity at the circular port of FIGS. 23A-23B, two degenerate resonant modes are excited by an input at the first rectangular port. When those two modes are discharged from the cavity the power will flow through the second rectangular port. The discharge can be caused most effectively by changing the phase of the input signal. Hence, the system would act as a pulse compressor.

Turning now to further embodiments of the invention. A novel type of dual circular polarizer for simultaneously receiving and transmitting right-hand and left-hand circularly polarized waves is provided and presented herein. The current embodiment includes an H-plane T junction of rectangular waveguide, one circular waveguide as an E-plane arm located on top of the junction, and two metallic pins used for matching. Provided herein is the theoretical analysis and design of the three-physical-port and four-mode polarizer by solving Scattering-Matrix of the network and using a full-wave electromagnetic simulation tool. The optimized polarizer has the advantages of a very compact size with a volume smaller than $0.6\lambda^3$, low complexity and manufacturing cost. A couple of the polarizer has been manufactured and tested, and the experimental results are basically consistent with the theories.

The circular polarizer converts a RHCP and/or LHCP into linearly polarized signals of vertically polarized (VP) and/or horizontally polarized (HP) waves, or is used in a reverse way. The transformation of circular polarization with linear polarization is generally realized by loading the discontinuities of a stepped-septum, stepped-corrugations, grooves and loaded dielectrics.

The current embodiment provides a new compact circular polarizer. This work is motivated by the development of instrumentations for the next generation experiments detecting the polarization of the cosmic microwave background (CMB) in order to understand the very early Universe. The incident circularly polarized radiations are received by an array of circular feed horns, converted, and then separated into two rectangular waveguides for respective analysis. In order to build an instrument with hundreds of array elements, each unit needs to be small to allow for close-packing Previous circular polarizers such as microstrip polarizer have the disadvantage of narrow bandwidth and low efficiency due to losses of conductor, dielectric and surface wave.

For a dual circular polarizer, two devices were previously needed, that included a circular polarizer to convert RHCP and LHCP radiation into respective VP and HP waves, and an ortho-mode transducer (OMT) to split the VP and HP waves into two separate waveguide ports. The polarizer together with the OMT forms a sub-system with three physical interface ports, whose total size is relatively large. The current embodiment includes a new more compact dual circular polarizer, whose generation and mechanism is significantly different from those known in the art. According to the current embodiment, the isolation of two rectangular ports and generating the RHCP and LHCP in the circular port are provided by the H-plane stub and two central pins. The network and S-matrix for the present polarizer are provided herein. The designed frequency range of the polarizer is in the Ka-band, and it should be emphasized that this device can be scaled to different frequency bands.

Figure 28:
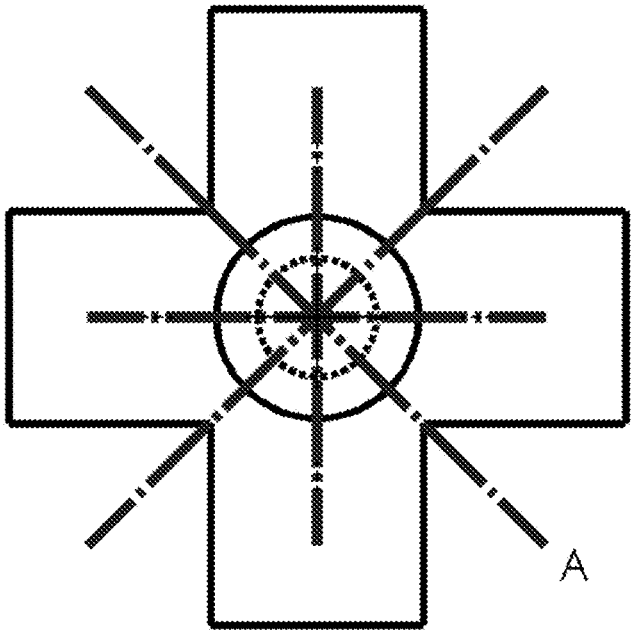
FIG. 28 shows a symmetric turnstile of rectangular waveguides coupled to a circular waveguide, according to one embodiment of the invention.

Turning now to analysis and optimization of one embodiment of a turnstile polarizer, consider a symmetric structure shown in FIG. 28, having a turnstile of rectangular waveguides coupled with a circular waveguide in the E-plane. This structure has five ports (four rectangular ports labeled Port 1, Port 3, Port 4 and Port 5, and one circular labeled Port 2) and six modes (identified as Port N:M, where N is the port number and M is the mode number associated with Port N). There are four symmetric planes: diagonal planes A and B, and horizontal and vertical planes C and D. Shown herein, the S-parameter for the OMTs is significantly different from that for the design of the current embodiment. The Scattering-Matrix for the six modes is the following:

$$S = \frac{1}{2}\begin{pmatrix} 0 & \sqrt{2} & 0 & 1 & 1 & 0 \\ \sqrt{2} & 0 & 0 & 0 & 0 & -\sqrt{2} \\ 0 & 0 & 0 & \sqrt{2} & -\sqrt{2} & 0 \\ 1 & 0 & \sqrt{2} & 0 & 0 & 1 \\ 1 & 0 & -\sqrt{2} & 0 & 0 & 1 \\ 0 & -\sqrt{2} & 0 & 1 & 1 & 0 \end{pmatrix}$$

If incident power from only Port 1, corresponding to a1=[1; 0; 0; 0; 0; 0]$^T$, the output vector is $b_1=S\cdot a_1=[0, \sqrt{2}, 0, 1, 1,$ $0]^T/2$. implying that ½ power is excited at Port 2; two $TE_{10}$ modes with ¼ equal power and equivalent phase are generated at Ports 3 and 4; and Port 5 is isolated. For input power from four rectangular ports with equal amplitude but with specific incident phases, if line A is an electric boundary and B is a magnetic boundary, then the equivalent input column vector is $a_2=[1, 0, 0, -1, 1, -1]^T/2$ and the output vector is $b_2=S\cdot a_2=[0, \sqrt{2}, \sqrt{2}, 0, 0, 0]^T/2$ if line A is an magnetic boundary and B is a electric boundary, then the equivalent input column vector is $a_3=[1, 0, 0, 1, -1, -1]^T/2$, and the output vector is still $b_2=S\cdot a_3=[0, \sqrt{2}, \sqrt{2}, 0, 0, 0]^T/2$, which means that there is equal excitation of modes Port 2:1 and Port 2:2, and no reflection in any rectangular port. If both A and B are magnetic boundaries, then the input and output vector are either the same $a_3=[1, 0, 0, 1, 1,]^T/2$, there is no mode excited in the circular waveguide when the higher order mode (i.e., $TM_{01}$) is cutoff in the circular waveguide. Similarly, there is no mode excited if both A and B are electric boundaries. By assigning A as an electric boundary and B as a magnetic boundary, the turnstile junction is decomposed to four units, and a quarter structure consisting of Port 1 and 1/4 of Port 2 is obtained. By using the 3-D electromagnetic simulation tool HFSS, the quarter structure is optimized, whose S parameter can be matched by adding two metallic posts to the center and adjusting their heights and diameters. The matched quarter structure supplies a range of parameters of the pins to help to realize the whole S-Matrix in HFSS simulation. The finally optimized field distribution and S parameters are shown in FIGS. 29A-29B.

Figure 29A:
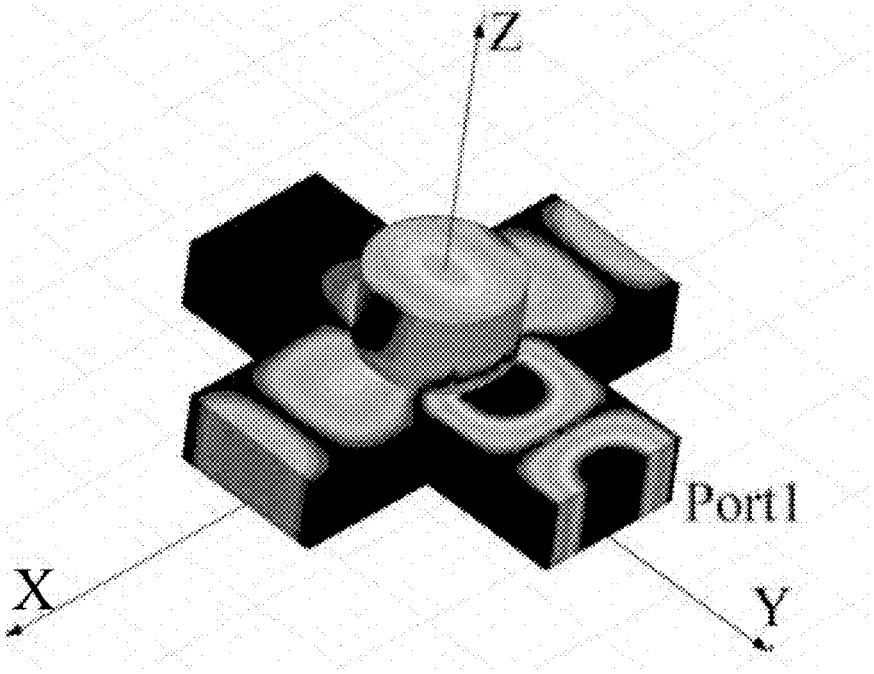
FIG. 29A-29B show (FIG. 29A) the transient surface electric field and (FIG. 29B) S parameters of the 5-port symmetric structure; 'o' and '*' respectively for $S_{13}$ and $S_{14}$ (Wave incidence from port 1 with a unit power), according to one embodiment of the invention.
Figure 29B:
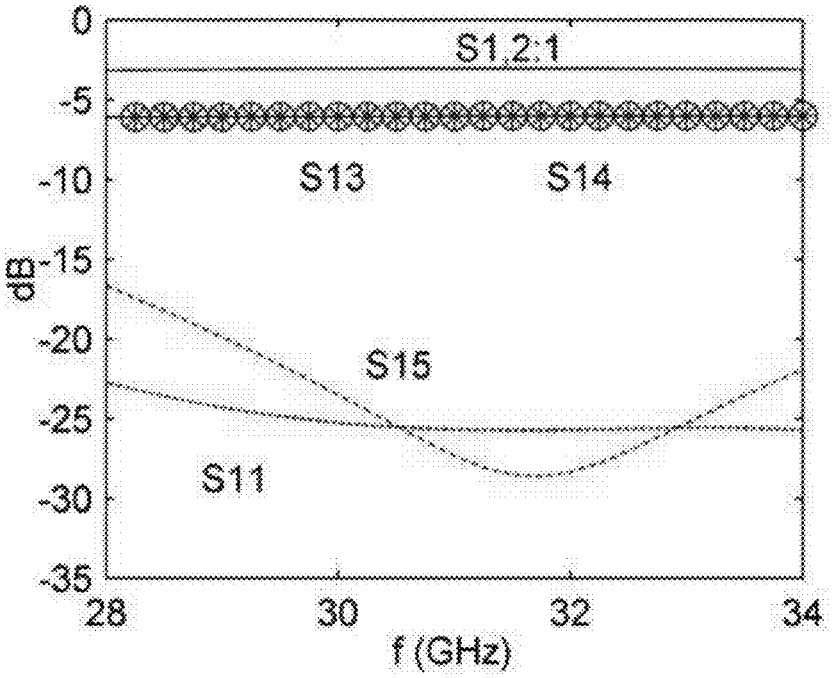
Figure 30A:
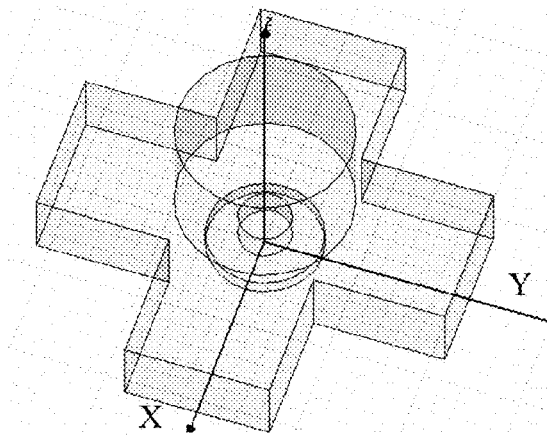
FIGS. 30A-30C show a turnstile OMT structure (FIG. 30A) with two posts, (FIG. 30B) transient surface field for incident wave at Port 1 and (FIG. 30C) S-parameters $S_{1,2:1}$~−3 dB, $S_{13}$ and $S_{14}$ have overlapped curves, $S_{11}$ and $S_{15}$ have overlapped curves), according to one embodiment of the invention.
Figure 30B:
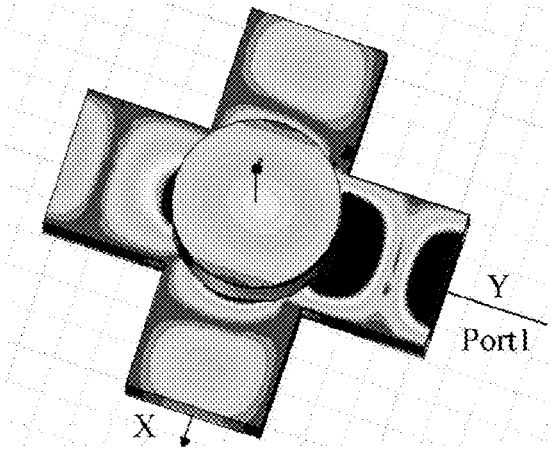
Figure 30C:
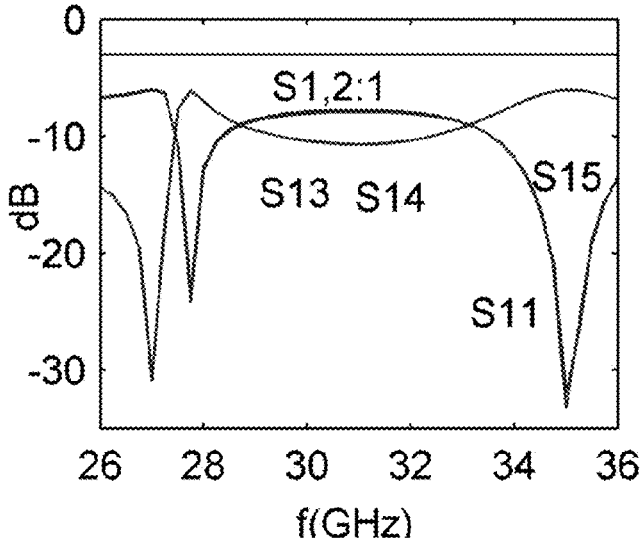

FIGS. 29A-29B show that, when the structure (see FIG. 29A) is matched and fed with unit power in Port 1, $TE_{11}$ mode Port 2:1 polarized along the incident rectangular waveguide with −3 dB power is excited in the circular waveguide Port 2; two $TE_{10}$ modes with power of −6 dB and equivalent phase are equally generated at the neighbor Ports 3 and 4; the opposite Port 5 is isolated; and there is no coupling to the $TE_{11}$ mode Port 2:2 ($S_{1,2:2}$<−50 dB in the frequencies, and not shown in FIG. 29B). As a comparison, take an example, the turnstile OMT is as illustrated in FIG. 30A. For an incident wave at Port 1, one-half power is excited in the circular port, as shown in FIGS. 30B-30C, however, the opposite port is not isolated, there are strong reflection back, and the neighbor ports have <¼ power. The S-parameters for the turnstile OMT are also found to be different from the structure presented here.

Figure 31A:
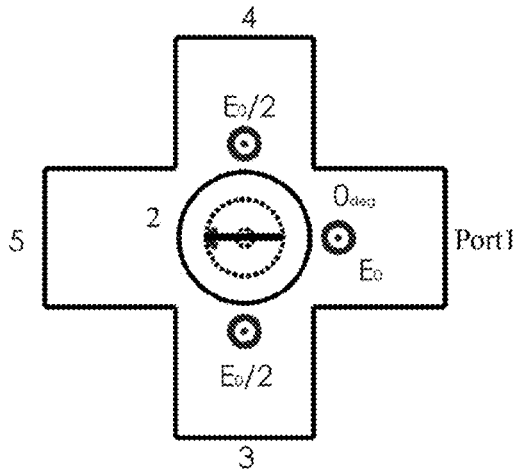
FIGS. 31A-31C show excited modes and the corresponding phases for different incident ports, (FIG. 31A) Port 1 fed in with 0° wave, (FIG. 31B) Port 3 with 0° wave, (FIG. 31C) Port 4 fed in with 180° wave, where the circled cross and circled dot symbols respectively represents transient vector of the electric field in and out of the page, according to one embodiment of the invention.
Figure 31B:
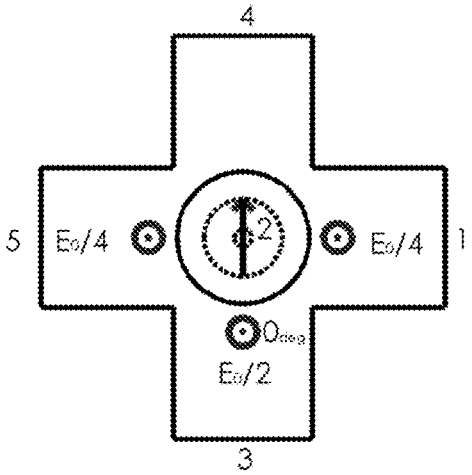
Figure 31C:
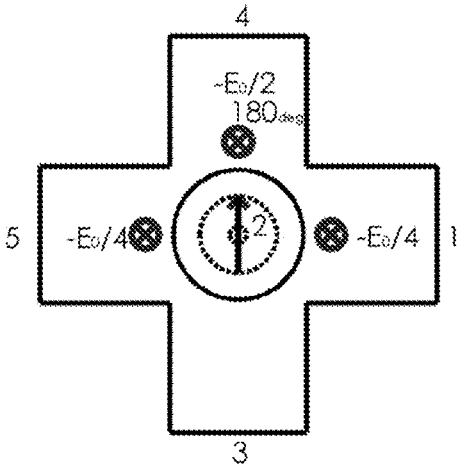

Turning now to how the polarizer is enabled. When incident wave $E_0$ is fed in Port 1, the excited field $E_0/2$ towards Port 3 and Port 4 are the same with equal phases, shown in FIG. 31A. It should be emphasized that the phase of the incident wave at the central area determines the phases of the excited waves in adjacent ports and Port 2. For instance, the incident wave from Port 3 with 0° phase and field $E_0/2$ at the central area excites the neighbor Port 5 and Port 1 with transient electric vector direction out of page and field $E_0/4$, and electric vector of mode Port 2:2 towards Port 4 with field $\sqrt{2}E_0/4$, shown in FIG. 31B; incident wave from Port 4 with 180° phase and field $-E_0/2$ at the central area excites the neighbor Port 5 and Port 1 with transient electric vector direction into the page and field $-E_0/4$, and electric vector of mode Port 2:2 also towards Port 4 with field $\sqrt{2}E_0/4$ illustrated as FIG. 31C. The question is how could the Port 3 and Port 4 have 180° phase difference at the central area? By placing a short on arms 3 and 4, and adjusting their phase length difference to be equal to $(2n+1)\lambda_g/4$, where n is an nonnegative integer, when the waves reflected from the shorted Ports of 3 and 4 arrives at the central area, they will have a phase difference of 180°, which means two opposite incident phases. Consequently, the Port 2:2 respectively excited by the shorted Ports 3 and 4 are summed to $\sqrt{2}/2E_0$ and the $TE_{10}$ modes generated towards Port 1 and 5 are fully cancelled. Thus, two orthogonal $TE_{11}$ modes with equal amplitude are excited by the structure.

Figure 32A:
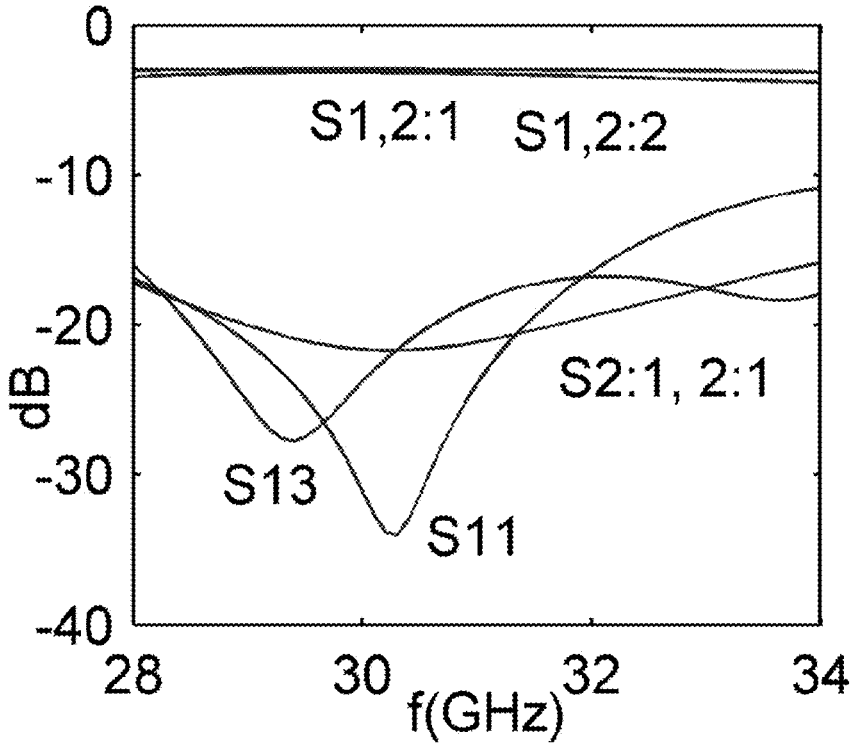
FIG. 32A-32B show S parameters of the turnstile polarizer for the arm 3 length of (FIG. 32A) 5.6 mm and (FIG. 32B) 0 mm, according to one embodiment of the invention.

When the phase difference of two orthogonal mode Port 2:1 and Port 2:2 is 90° or −90°, the turnstile polarizer is realized, and the optimized dimensions are illustrated in Table 4, and the S-parameter is shown in FIG. 32A. A turnstile polarizer was previously researched. However, it did not give any theoretical or experimental S-parameters. Only far field radiation patterns were recorded, and there was no information on its bandwidth. The physics of how the polarizer realized was not explained clearly. Actually, the phase response on frequency influences the bandwidth of the polarizer, which will be shown in the following paragraph.

TABLE 4

The optimized parameter for a turnstile polarizer (in unit of mm).

| Rectangular waveguide | | Circular waveguide | Length difference $L_{arm4} - L_{arm3}$ $(2n + 1)\lambda_g/4$ | Cylinder Pins | | | |
|---|---|---|---|---|---|---|---|
| Width $W_r$ | Height $H_r$ | Radius $R_c$ | $L_{arm3}$ not close to zero | Radius $R_1$ | Height $Z_1$ | Radius $R_2$ | Height $Z_2$ |
| 7.6 | 3.455 | 3.6 | | 2.12 | 1.05 | 0.48 | 3.56 |

Figure 32B:
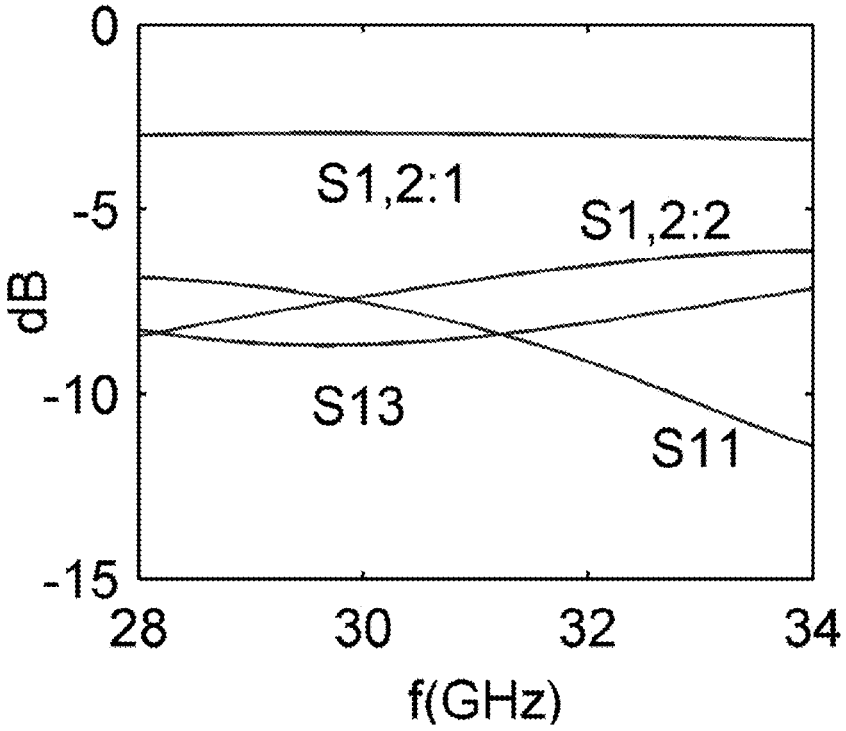
Figure 33:
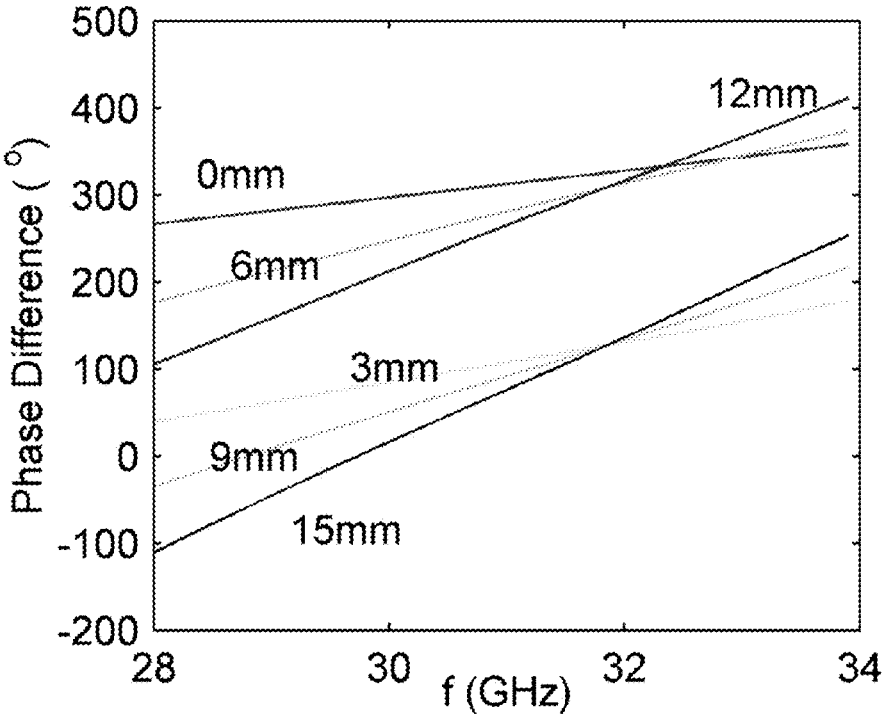
FIG. 33 shows variation of phase difference of $TE_{11}$ modes 1 and 2 with arm lengths $L_3$, according to one embodiment of the invention.

The phase of the mode Port 2:2 depends on the arm lengths $L_3$ and $L_4$ of the branches at Ports 3 and 4. The phases $\phi_3$ and $\phi_4$ of the reflected wave at the entrance of the central area is $\phi_{3,4}\sim 2\beta L_{3,4}$, where β is the propagation constant. Thus, the phase of excited the mode Port 2:2 is varied for different lengths $L_{3,4}$, and the phase difference of two orthogonal mode Port 2:1 and Port 2:2 is varied with branch lengths, as shown in FIG. 33. It is found that the slope of the phase difference decreases when the arm length shortens and it reaches the minimum when the arm 3 vanishes and the arm 4 is $\frac{1}{4}\lambda_g$ long. This is because the propagation constant β depends on frequency, $\phi_{3,4}(f, L_{3,4})\sim 2\beta(f, L_{3,4}$, and the longer $L_{3,4}$, the larger the variation range of $\phi_{3,4}$ for different frequencies. Thus, the slope of phase variation of $TE_{11}$ mode 2 decreases with shortening the arm length. Consequently, the profile of the circular polarizer has become an H-type T junction of rectangular waveguide, with a shorted H-plane arm of a $\frac{1}{4}\lambda_g$ long, and one E-plane circular waveguide located on top. However, when the arm 3 trends towards zero and the arm 4 is close to $\frac{1}{4}\lambda_g$, the evanescent wave excited at port 3 and port 4 will significantly disturb the electric boundary, hence, the center pins used to match the S-Matrix for a Turnstile polarizer becomes mismatched, as illustrated the S parameters in FIG. 32B, compared with the matched one in FIG. 32A. Thus, using the five ports with six modes to analyze the new H-type T junction polarizer is not suitable any more. Consequently, previous device could not make one arm close to zero. FIG. 33 shows variation of phase difference of $TE_{11}$ modes 1 and 2 with arm lengths $L_3$, according to one embodiment of the invention.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed:

1. A multi-port waveguide, comprising:

a. a rectangular waveguide, wherein said rectangular waveguide comprises a Y-shape structure along an, x-y plane, having a first top arm, a second top arm, and a base arm, wherein said first top arm comprises a first rectangular waveguide port, wherein said second top arm comprises a second rectangular waveguide port, wherein an end of said base arm comprises a third rectangular waveguide port that is capable of supporting a $TE_{10}$ mode and a $TE_{20}$ mode, wherein said third rectangular waveguide port comprises rounded edges that are parallel to a z-axis relative to said x-y plane of said rectangular waveguide;

b. a circular waveguide, wherein said circular waveguide comprises a circular waveguide port that is capable of supporting a left hand circular polarization $TE_{11}$ mode and a right hand circular polarization $TE_{11}$ mode, wherein said circular waveguide is coupled to a broad wall of said base arm of said rectangular waveguide; and c. a matching feature, wherein said matching features is disposed on said broad wall of said base arm that is opposite of said circular waveguide, wherein said matching feature is capable of terminating said third rectangular waveguide port, wherein said first rectangular waveguide port, said second rectangular waveguide port and said circular waveguide port are capable of supporting 4-TE modes.

2. The multi port waveguide of claim 1, wherein said matching feature comprises a stub feature, wherein said stub feature projects outward from said broad wall of said base arm.

3. The multi port waveguide of claim 1, wherein said matching feature comprises a capacitive dome, wherein said capacitive dome projects inward from said broad wall of said base arm.

4. The multi port waveguide of claim 1, wherein said matching feature comprises a pin feature, wherein said pin feature projects outward from said broad wall of said base arm.

5. The multi port waveguide of claim 1, wherein said circular waveguide is disposed at a pre-defined distance from a junction of said first top arm and said second top arm along said base arm, wherein said pre-defined distance is according to matching and phase properties of said left hand circular polarization $TE_{11}$ mode and said right hand circular polarization $TE_{11}$ mode, wherein a phase difference between said $TE_{11}$ mode along said first top arm and said $TE_{11}$ mode said second top arm is 90-degrees.

* * * * *